US006164748A

United States Patent [19]

Taneya et al.

[11] Patent Number: 6,164,748

[45] Date of Patent: Dec. 26, 2000

[54] LIQUID DISCHARGE METHOD AND LIQUID JET APPARATUS

[75] Inventors: Yoichi Taneya, Yokohama; Hiroyuki Ishinaga, Tokyo; Toshio Kashino, Chigasaki; Hiroyuki Sugiyama, Sagamihara; Tomoyuki Kaneda, Yokohama, all of Japan

[73] Assignee: Canon Kabushiki Kaisha, Tokyo, Japan

[21] Appl. No.: 09/122,330

[22] Filed: Jul. 24, 1998

[30] Foreign Application Priority Data

Jul. 31, 1997 [JP] Japan ..... 9-206553
Jul. 6, 1998 [JP] Japan ..... 10-190437

[51] Int. Cl.[7] ..... B41J 2/205

[52] U.S. Cl. ..... 347/15

[58] Field of Search ..... 347/9, 11, 20, 347/15, 65, 63, 43, 12, 14

[56] References Cited

U.S. PATENT DOCUMENTS

| | | | |
|---|---|---|---|
| 4,468,679 | 8/1984 | Suga et al. | 346/140 |
| 4,723,129 | 2/1988 | Endo et al. | 347/56 |
| 4,908,638 | 3/1990 | Albosta et al. | 347/43 |
| 5,208,605 | 5/1993 | Drake | 347/15 |
| 5,285,215 | 2/1994 | Liker | 347/15 |
| 5,606,351 | 2/1997 | Hawkins | 347/15 |
| 5,821,962 | 10/1998 | Kudo et al. | 347/65 |

FOREIGN PATENT DOCUMENTS

| | | |
|---|---|---|
| 06198914 | 7/1994 | European Pat. Off. . |
| 0737585A1 | 10/1996 | European Pat. Off. . |
| 0775583A2 | 5/1997 | European Pat. Off. . |
| 3416449A1 | 2/1985 | Germany . |
| 61-59911 | 3/1986 | Japan . |
| 61-59914 | 3/1986 | Japan . |
| 8-23015 | 1/1996 | Japan . |
| 8-230215 | 9/1996 | Japan . |

*Primary Examiner*—John Barlow
*Assistant Examiner*—Juanita Stephens
*Attorney, Agent, or Firm*—Fitzpatrick, Cella, Harper & Scinto

[57] ABSTRACT

A liquid discharge method is designed for a liquid jet head provided with first discharge openings, a first liquid flow path conductively connected with each of the first discharge openings, first energy generating devices for generating energy for the discharge of droplets from the first discharge openings, second discharge openings, a second liquid flow path conductively connected with each of the second discharge openings, and second energy generating devices for generating energy for the discharge of droplets from the second discharge openings. Then, preceding the discharge of the first droplet from the discharge opening at a first discharge speed $v_1$, the second droplet is discharged from the second discharge opening at a second discharge speed $v_2$ smaller than the first discharge speed, and before each of the liquid droplets being impacted on an object, the first liquid droplet and the second liquid droplet are allowed to collide with each other to be combined. In this way, it becomes possible to allow two droplets to be in contact or to collide with each other reliably to be mixed between the liquid jet head and the object within a range that does not render any hinderance practically even if discharge speeds may fluctuate, hence obtaining precise images in higher quality.

38 Claims, 18 Drawing Sheets

LIQUID DISCHARGE METHOD AND LIQUID JET APPARATUS

BACKGROUND OF THE INVENTION

1. Field of the Invention

The present invention relates to a liquid discharge method and a liquid jet apparatus for discharging liquid by use of energy generating devices. More particularly, the present invention relates to a liquid discharge method and a liquid jet apparatus for discharging a desired liquid by the action of bubbles to be created by causing thermal energy to act upon liquid.

2. Related Background Art

There has been known conventionally an ink jet recording method, that is, the so-called bubble jet recording method, which performs the image formation in such a manner that energy, such as heat, is given to ink in the form of pulses in response to recording signals so as to create the change of states in ink with its abrupt voluminal changes to follow, and that ink is discharged from the discharge openings by the acting force based upon this change of states, thus adhering to a recording medium for the formation of images. The recording apparatus that uses this bubble jet recording method is generally provided with discharge openings for discharging ink; ink flow paths conductively connected with the discharge openings; and heat generating devices (electrothermal transducing devices) which are arranged in the ink flow paths as energy generating means for discharging ink as disclosed in the specifications of Japanese Patent Publication No. 61-59911, Japanese Patent Publication No. 61-59914, and U.S. Pat. No. 4,723,129, among some others.

With a recording method of the kind, images can be recorded in high quality at high speeds with a lesser amount of noises. At the same time, the discharge openings of the head can be arranged in high density to carry out this recording method. Therefore, among a number of advantages, this method makes it easier to obtain images in high resolution, and also, color images recorded by use of a smaller apparatus. As a result, the bubble jet recording method has been widely used for a printer, a copying machine, a facsimile equipment, or other office equipment in recent years. Furthermore, this method begins to be adopted even for a textile printing system or other systems for industrial use.

However, for the ink jet recording method, the volume of ink droplet to be discharged per pixel portion is almost constant usually. Therefore, a special device is needed in order to execute a gradation recording. In this respect, there is disclosed in Japanese Patent Laid-Open Application No. 8-230215, for example, an ink jet recording head that discharges a mixture of ink liquid and dilution for printing on a printing medium, hence making a gradation recording possible.

However, in the case of the ink jet recording head disclosed in Japanese Patent Laid-Open Application No. 8-23015, it is set forth as a premise that the discharge speed is invariable when ink droplets are discharged from each of the discharge openings. In this laid-open application, there is no disclosure at all as to the exact method for effectuating the collision between ink droplets to be discharged from the ink jet recording head the discharge speed of which tends to fluctuate when actually in use. Also, in order to materialize the gradation recording, two kinds of ink droplets should collide with each other in one case, but not in the other. If the impact positions of ink droplets should be deviated greatly on a recording medium depending on these two deferent cases, it is impossible to obtain any images in high quality at all. Nevertheless, there is no technical disclosure on this aspect in the above-mentioned laid-open application.

Now, the problems encountered conventionally by the ink jet recording method have been discussed on the execution of the gradation recording so far. However, this operation, that is, two kinds of droplets are discharged and mixed before being impacted on a printing medium or other object, is not necessarily limited to the gradation recording described above.

For example, assuming that a substance C created by the reaction of A+B→C changes to be C' when adhering to an object, there may be a case where the substance C thus created is a material itself which is not stable in the formation of a pattern which is selectively made by the C' that adheres to the object. In such a case, a first droplet containing A and a droplet containing B are discharged separately from different discharge openings and are caused to collide with each other during its flight to the object so that the A and B react upon themselves to create C. Then, immediately after that, the droplet that contains C is impacted on the object and changes to be C'. It is preferable to adopt a structure of the kind from the view point of the positional accuracy or other requirements for the formation of pattern made by the C'. However, in this case, too, there are the problems discussed above still remaining as those should be solved.

SUMMARY OF THE INVENTION

It is an object of the present invention to provide a liquid discharge method for enabling droplets to be in contact or to be collided within a practically allowable range and provide the impact positions with a smaller deviation even if the discharge speed is instable when droplets are discharged separately from the different discharge openings and should be in contact or collided with each other to act upon themselves before being impacted on the object. It is also the object of the invention to provide a liquid jet apparatus using this liquid discharge method.

In order to achieve these objectives, the liquid discharge method of the present invention is the one designed for a liquid jet head provided with first discharge openings, a first liquid flow path conductively connected with each of the first discharge openings, first energy generating devices for generating energy for the discharge of liquid droplets from the first discharge openings, second discharge openings, a second liquid flow path conductively connected with each of the second discharge openings, and second energy generating devices for generating energy for the discharge of liquid droplets from the second discharge openings. Then, preceding the discharge of the first liquid droplet from the discharge opening at a first discharge speed $v_1$, the second liquid droplet is discharged from the second discharge opening at a second discharge speed $v_2$ smaller than the first discharge speed, and before each of the liquid droplets being impacted on an object, the first liquid droplet and the second liquid droplet are allowed to collide with each other to be combined.

Also, the liquid jet apparatus of the present invention is provided with first discharge openings, a first liquid flow path conductively connected with each of the first discharge openings, first energy generating devices for generating energy for the discharge of liquid droplets from the first discharge openings, second discharge openings, a second liquid flow path conductively connected with each of the second discharge openings, and second energy generating devices for generating energy for the discharge of liquid droplets from the second discharge openings, and a driving circuit for driving the first energy generating devices and the second energy generating devices. Then, preceding the discharge of the first liquid droplet from the discharge opening at a first discharge speed, the second liquid droplet is discharged from the second discharge opening at a second discharge speed smaller than the first discharge speed, and before each of the liquid droplets being impacted on an object, the first liquid droplet and the second liquid droplet is allowed to collide with each other to be combined.

With the above-mentioned liquid discharge method and liquid jet apparatus, it is possible to provide a liquid discharge method and a liquid jet apparatus whereby to solve the problems discussed above, because the discharge speed of the first droplet is set larger than that of the second discharge speed.

The problems discussed above can be solved by the above-mentioned liquid discharge method and the individual liquid jet apparatus, but it is preferable to satisfy one or more of the following conditions the details of which will be described later: in other words, when the discharge time differential δT between the first liquid droplet and the second liquid droplet is controlled, it is preferable to satisfy the condition given below.

$$\max\left(0,\ \frac{-L_1(v_1\cos\theta_1 - v_2\cos\theta_2) + (r_1+r_2)\sqrt{v_1^2+v_2^2-2v_1v_2\cos(\theta_1-\theta_2)}}{v_1v_2\sin(\theta_1-\theta_2)}\right) \leq \delta T \leq \frac{-L_1(v_1\cos\theta_1 - v_2\cos\theta_2) - (r_1+r_2)\sqrt{v_1^2+v_2^2-2v_1v_2\cos(\theta_1-\theta_2)}}{v_1v_2\sin(\theta_1-\theta_2)}$$

where the $L_1$ is the distance between the center of the first discharge opening and that of the second discharge opening; the $r_1$ and $r_2$ are the radii of the ink droplets discharged from the first and second discharge openings, respectively; the $\theta_1$ and $\theta_2$ are the angles of ($0° \leqq \theta_1 < \theta_2 < 90°$) formed by each of the central axes of the first and second discharge openings to the perpendiculars to the discharge opening surface.

It is arranged to control the central axes of the first and second drops to intersect on one point between the liquid jet head and the object, and at the same time, control these centers to be in agreement at this intersecting point in accordance with the first discharge speed and second discharge speed.

Also, it is arranged to control the impact position of liquid droplets on the object after being combined is positioned between the individual impact positions of the first and the second liquid droplet on the object.

Here, the respective differences in the impact position of the combined liquid droplets on the object, the individual impact position of the first liquid droplet on the object, and the individual impact position of the second liquid droplet on the object are within a range of less than the dot pitches of the pixel density to be output and used for recording images on the object. Preferably, it should be less than ½ of the dot pitches. More preferably, it should be less than ⅓ thereof.

Also, the mass of the first liquid droplet should be larger than the mass of the second liquid droplet.

Also, the first discharge speed $v_1$ and the second discharge speed $v_2$ satisfy a condition of $v_1/v_2 > 1.10$.

For each of the inventions described above, liquid supplied to the first liquid flow path and liquid supplied to the second liquid flow path are generally different from each other. For example, these are ink different from each other in colorant densities or kinds of colorants thereof.

Further, for each of the inventions described above, the liquid jet head should preferably be provided with a plurality of first discharge openings and a plurality of second discharge openings corresponding to each of the first discharge openings, respectively, and as energy generating devices, it is preferable to use the bubble generating devices that generate bubbles in liquid and discharge liquid droplets by acting force thereof. As the bubble generating device, it is preferable to use heat generating devices to give heat to liquid for creation of bubbles. Then, as the heat generating devices, it is preferable to use electrothermal transducing devices.

BRIEF DESCRIPTION OF THE DRAWINGS

FIG. 1A is a cross-sectional view which shows the side end of the ink jet head in the flow path direction; FIG. 1B is a perspective sectional view, observed from the upper surface.

DETAILED DESCRIPTION OF THE PREFERRED EMBODIMENTS

Hereinafter, with reference to the accompanying drawings, the description will be made of the embodiments in accordance with the present invention.

Figure 1A:
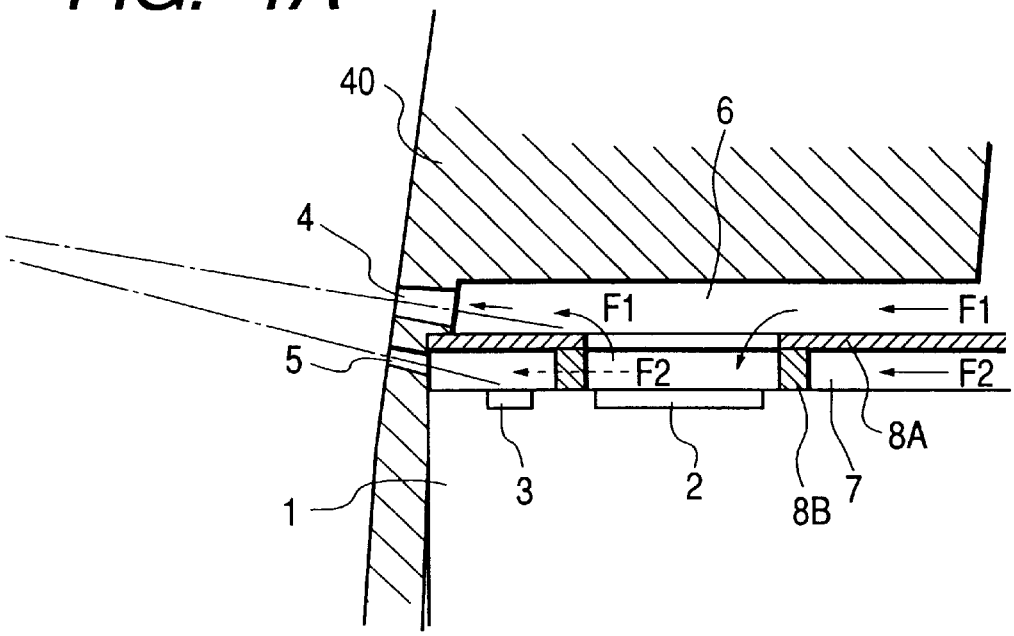
FIGS. 1A and 1B are views which illustrate a liquid jet head to which the liquid discharge method is applicable in accordance with one embodiment of the present invention.
Figure 1B:
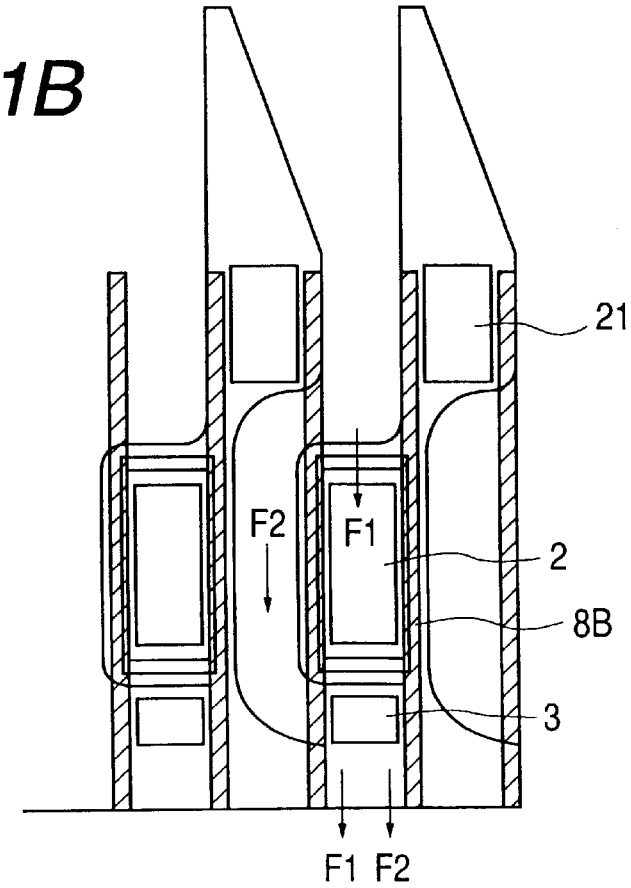
Figure 2A:
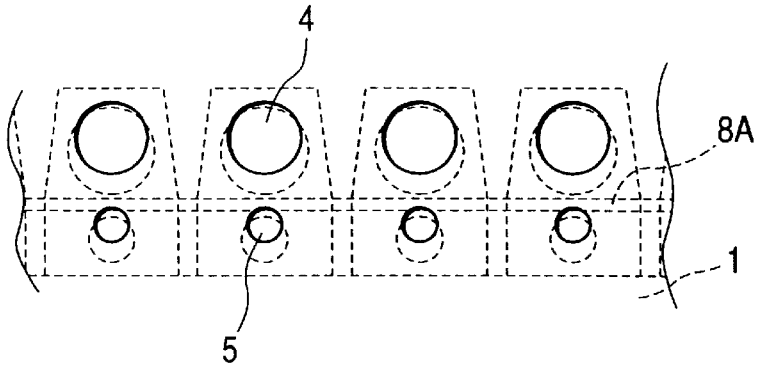
FIG. 2A is a front view which shows one region of the orifice surface of the liquid jet head represented in FIGS. 1A and 1B.
Figure 2B:
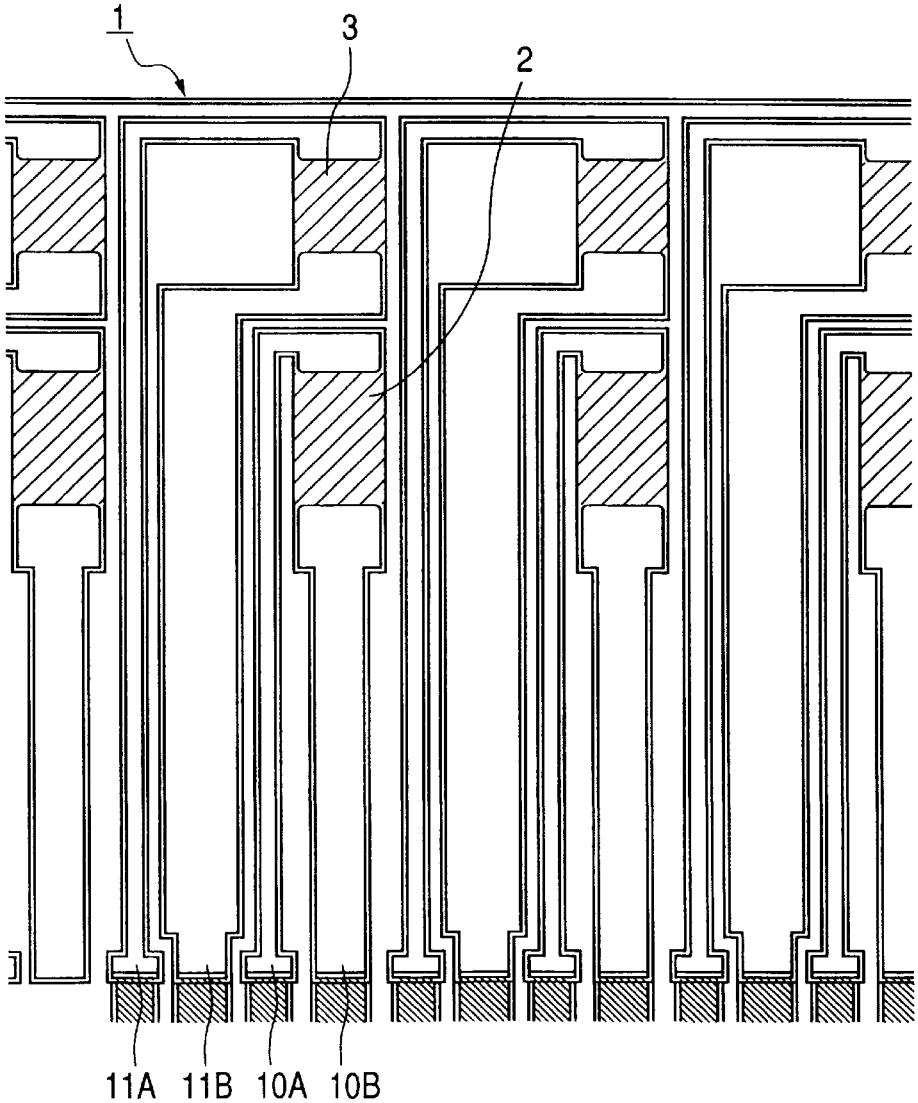
FIG. 2B is a plan view which shows the circumferential area of the heat generating devices on an elemental substrate.

At first, using FIGS. 1A, 1B, 2A and 2B the description will be made of a liquid jet head to which the liquid discharge method is applicable in accordance with one embodiment of the present invention. FIGS. 1A and 1B are views which illustrate a liquid jet head to which the liquid discharge method is applicable in accordance with one embodiment of the present invention; FIG. 1A is a cross-sectional view which shows the side end of the ink jet head in the flow path direction; FIG. 1B is a perspective sectional view, observed from the upper surface. Also, FIG. 2A is a front view which shows one region of the orifice surface of this liquid jet head. FIG. 2B is a plan view which shows the circumferential area of the heat generating devices on an elemental substrate. Here, the description will be made assuming that a liquid jet head is used as the ink jet recording head to be used for ink jet recording. It is of course possible to adopt this liquid jet head for any other uses than the ink jet recording.

On the surface of the elemental substrate 1, a first heat generating device 2 and a second heat generating device 3 are arranged in the direction of the flow path formation in order to give thermal energy for creating bubbles in liquid. Of the sides of the elemental substrate 1, the first heat generating device 2 is formed on the side farther away from the orifice face side (the face on which discharge openings 4 and 5 are formed as described later), and the second heat generating device 3 is formed on the side nearer to that face. In accordance with the present embodiment, the heat generating devices 2 and 3 are the electrothermal transducing devices the equivalent circuit of which is indicated by its electrical resistance. Also, on the elemental substrate 1, a second liquid flow path 7, which is conductively connected with a second discharge opening 5, is arranged. On the upper part of this liquid flow path 7, a first liquid flow path 6, which is conductively connected with a first discharge opening 4, is arranged. On the orifice face, the first discharge opening 4 and the second discharge opening 5 are arranged in the direction from top to bottom so that the first discharge opening 4 is on the upper side. The first liquid flow path is formed by dry film, nickel, or resin such as polysulfone. The second liquid flow path 7 is formed by dry film or nickel.

A correction resistor 21 shown in FIG. 1B is arranged in series with the second heat generating device 3 so as to enable each of the first heat generating device 2 and the second heat generating device 3 to obtain appropriate foaming by the same driving condition. Also, it is preferable to make a specific value of resistance larger for the correction resistor 21 in order to suppress the heat generation per unit area.

Then, a separation plate 8A and a separation plate 8B are arranged between the first liquid flow path 6 and the second liquid flow path 7 so that only the first heat generating device 2 is formed in the first liquid flow path 6, while only the second heat generating device 3 is formed in the second liquid flow path 7. As described above, this liquid jet head is formed by the first liquid flow path 6 and the second liquid flow path 7 in the form of two-story structure, and the first story portion (the second liquid flow path 7) and the second story portion (the first liquid flow path 6) are separated by means of the separation plate 8A. However, since the first heat generating device 2, which is arranged for the first liquid flow path 6, is formed on the surface of the elemental substrate 1, the portion where the first heat generating device is present is structured in a wellhole fashion which does not have any separation plate between the first and second story portions. Instead of such separation plate, a separation wall 8B is arranged on the side end of the first story portion having this wellhole structure. In this way, the second liquid flow path 7 is arranged to bypass the region of the first heat generating device 2 and to make the separation of the first liquid flow path 6 and the second liquid flow path 7.

In FIGS. 1A and 1B, the liquid flow in the first liquid flow path 6 is indicated by an arrow Fl, while the liquid flow in the second liquid flow path 7 is indicated by an arrow F2. The liquid in the first liquid flow path 6 flows into it from the back of the first liquid flow path 6 (the side opposite to the first discharge opening 4), and passes the surface of the first heat generating device 2. The liquid is then discharged from the first discharge opening 4 lastly. The liquid in the second liquid flow path 7 flows in from the back of the second liquid flow path 7, and flows along the side face of the separation wall 8B that surrounds the first heat generating device 2. Lastly, it is discharged from the second discharge opening 5. As described above, since the first liquid flow path 6 conductively connected with the first discharge opening 4 and the second liquid flow path 7 conductively connected with the second discharge opening 5 are separated by the separation wall 8B to be independent form each other, it is possible not only to prevent any crosstalks between the first liquid flow path 6 and the second liquid flow path 7, but also, to prevent the liquids in these two liquid flow paths from being mixed before the discharge thereof. Further, the liquid in the second liquid flow path 7 flows along the side face of the separation wall 8B to arrive on the surface of the second heat generating device 3. As a result, it becomes possible not only to prevent the heat accumulation on the second heat generating device 3, but to produce effect dually on the heat accumulation of the first heat generating device 2. In this way, the temperature rise is suppressed at the time of high frequency driving.

With the structure thus arranged, it is possible to optimize the sizes of the heaters each formed in the respective liquid flow paths; the arrangement positions of heaters; the discharge opening configuration; and the area of the discharge openings. Then, it becomes possible to materialize a liquid jet head which is provided with the stable amount of droplets discharged from the first discharge opening 4 and the second discharge opening 5, discharge directions (the direction of the central axis of each discharge opening), and the discharge speed as well. For the liquid jet head of the present embodiment in particular, the central axis of the first discharge opening 4 and that of the second discharge opening 5 are arranged to intersect each other on one point on the liquid jet head side rather than on the object side, such as a printing medium, that faces the liquid jet head. The reason why the central axes are caused to intersect in this way is that the droplets discharged from the first discharge opening 4 and the second discharge opening 5 should be in contact or collide with each other during its flight, that is, before being impacted on an object, so that both liquids are mixed reliably. In this respect, each of the droplets has a radius or a shape that can be regarded as a sphere fundamentally. Therefore, even if a structure is arranged so that the central axes of the discharge openings 4 and 5 are in the twisted positions, for example, it is possible to allow both droplets to collide with each other provided that the shortest distance between the central axes is smaller than the sum of the radii of both of them. Here, it is to be understood that such structure is also within the scope of the present invention.

Further, as shown in FIG. 2A, the liquid jet head of the present embodiment is structured so that the plural sets of the above-mentioned first liquid flow path 6 and the second liquid flow path 7 are arranged on the elemental substrate 1 in the transverse direction, and also, the plural numbers of the first discharge openings 4 and second discharge openings 5 are arranged on the orifice face also in the transverse direction, respectively. Therefore, on the surface of the elemental substrate 1, a plurality of the first heat generating devices 2 and the same numbers of the second heat generating devices 3 are arranged corresponding to the numbers of this set. In this case, a first common liquid chamber (at 42 in FIG. 12) is arranged to be conductively connected with and shared by a plurality of first liquid flow paths 6 in order to supply liquid to each of the first liquid flow paths 6. Likewise, a second common liquid chamber (at 45 in FIG. 12) is arranged to be conductively connected with and shared by a plurality of second liquid flow paths 7 in order to supply liquid to each of the second liquid flow paths 7.

FIG. 2B is a plan view which partly shows the circumference of the heat generating devices on the elemental substrate 1. There are formed on one and the same elemental substrate 1 a plurality of first heat generating devices 2, a plurality of second heat generating devices 3, the wiring 10A and 10B each connected with each of the first heat generating devices 2, and the wiring 11A and 11B each connected with each of the second heat generating devices 3. The liquid jet head of the present embodiment does not use the separate substrates each for the first heat generating devices 2 and the second heat generating devices 3, respectively. As a result, the manufacturing process is not complicated, hence making it possible to maintain good production yield at lower costs. Also, in FIG. 2B, no correction resistor is used for the second heat generating device 3 as shown in FIG. 1B. In this mode, the conditional setting should be made for the voltage and pulse width in order to change the driving conditions.

Figure 3:
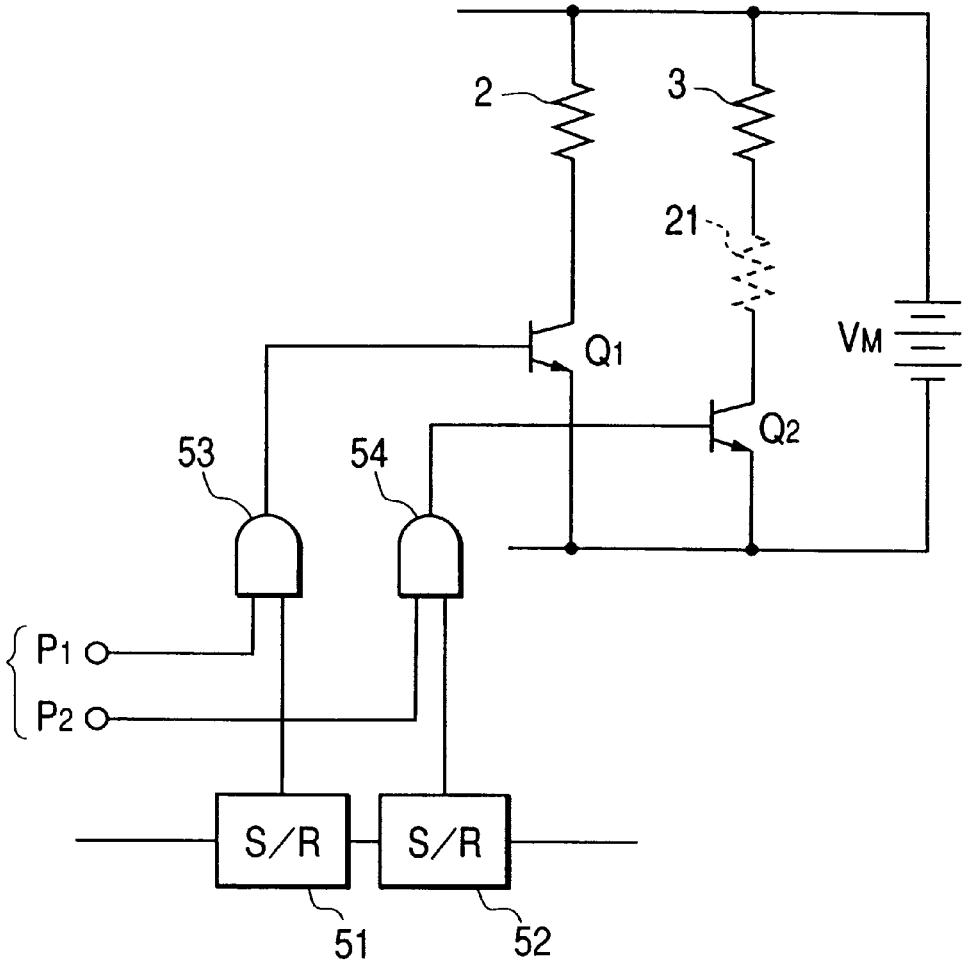
FIG. 3 is a diagram which shows one example of the circuit that generates the driving pulses given to the heat generating device.

Now, the description will be made of one example of the circuit structure for driving the first heat generating device 2 and the second heat generating device 3 with time differential, which is preferably usable for the liquid jet head described above. FIG. 3 is a circuit diagram which shows one example of the circuit that generates driving pulses given to the first heat generating device 2 and the second heat generating device 3. In FIG. 3, each of the heat generating devices 2 and 3, and the correction resistor 21 are represented by the symbol of electric resistance, respectively. Each one end of the heat generating devices 2 and 3 is connected with the positive pole of the electric supply source VM, and the other end thereof is connected with the respective collectors of the npn transistors Q1 and Q2. The respective emitters of the transistors Q1 and Q2 are connected with the negative pole of the electric supply source VM. Also, there are arranged the two shift registers (S/R) 51 and 52, and the AND gate 53 that obtains AND of the output of one of the shift register 51 and the driving pulse P1, thus outputting it to the base of the transistor Q1, and also, the gate 54 that obtains AND of the output of the other shift register 52 and the driving pulse P2, thus outputting it to the base of the transistor Q2. The shift registers 51 and 52 develop serial data and transmit them to each of the heat generating devices 2 and 3.

Figure 4:
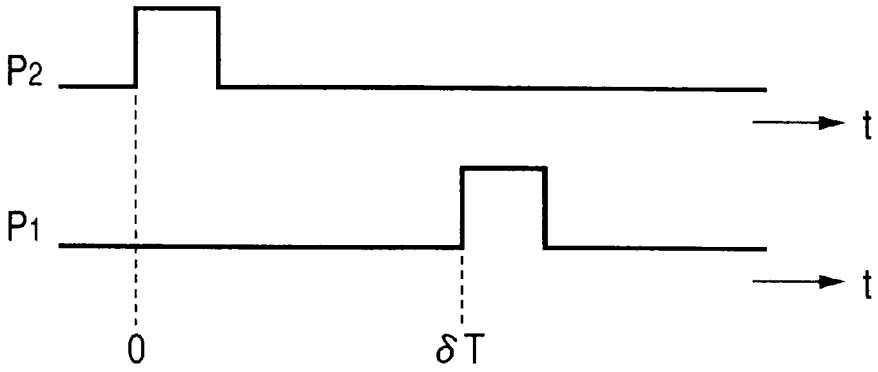
FIG. 4 is a timing chart which shows one example of the driving timing of the heat generating device.

The timing of the driving pulses P1 and P2 is as shown in FIG. 4. As compared with the driving pulse P2, the driving pulse P1 is delayed by δT. When the driving pulses P1 and P2 are inputted into the AND gates 53 and 54, the transistors (switching devices) Q1 and Q2 are turned on to supply current form the electric supply source VM to each of the heat generating devices 2 and 3 in accordance with the data from the shift registers 51 and 52. Here, since there is the time differential between the driving pulses P1 and P2, each of the heat generating devices 2 and 3 is driven in accordance with such time differential.

Figure 5:
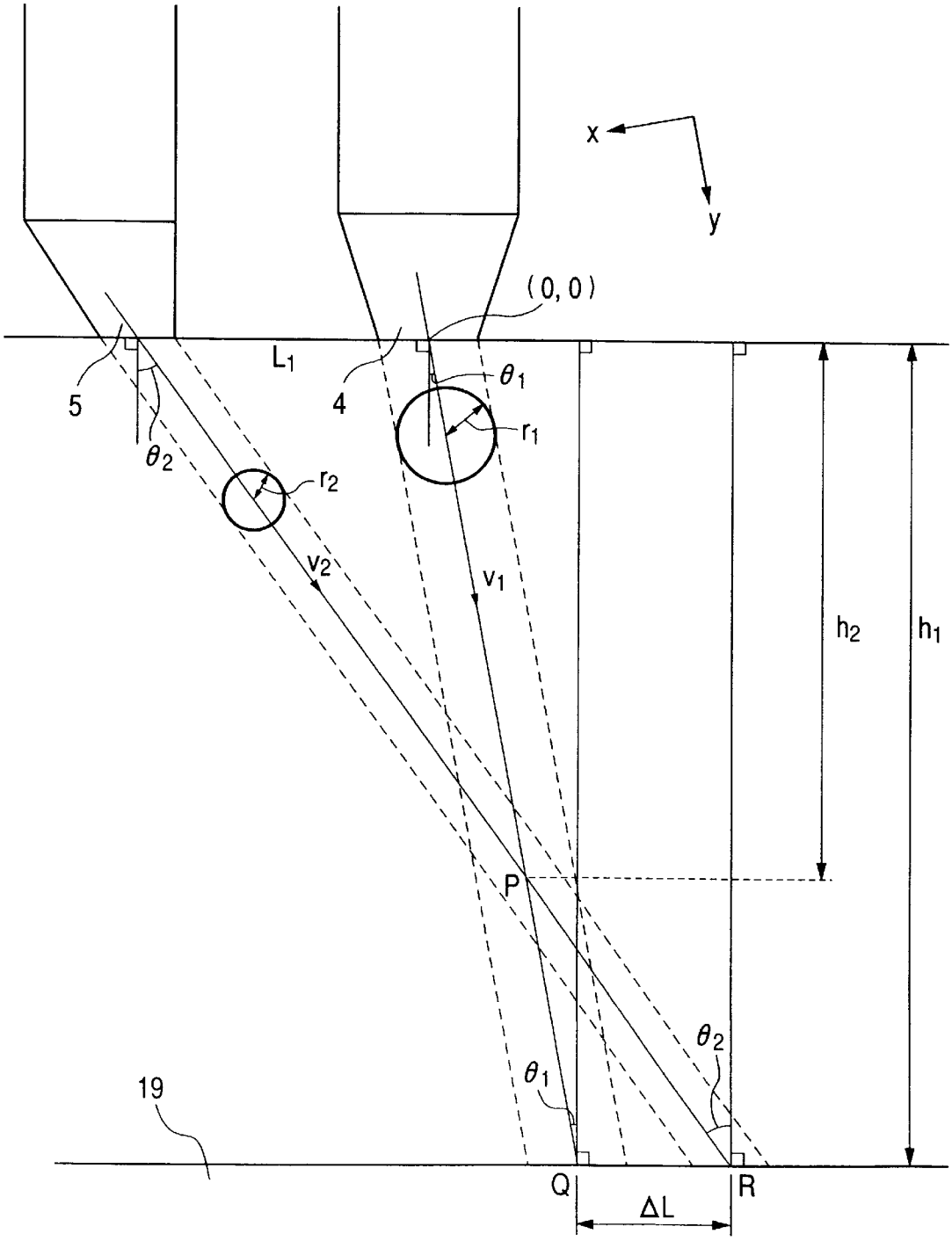
FIG. 5 is a view which illustrates the liquid discharge method in accordance with the present invention.

Now, in conjunction with FIG. 5 and FIGS. 6A to 6D, the description will be made of the liquid discharge method of the present invention which utilizes the liquid jet head and the driving circuit described above. FIG. 5 is a view schematically illustrating one example of the embodiment represented in FIGS. 1A and 1B on the basis of the coordinate axes given below.

In the following description, the plural numbers of the first discharge openings 4 and the second discharge openings 5 are provided for the liquid jet head, respectively. Then, the structure is arranged so that on the orifice face, each one of the first discharge openings 4 and the second discharge openings 5 form a pair, and the droplets discharged from the first discharge opening 4 and the second discharge opening 5, which belong to the same pair, are caused to collide with each other to be mixed during its flight, while no collision is allowed to take place between different pairs. In FIG. 5, therefore, it is assumed that the first discharge opening 4 and the second discharge opening 5, which are arranged on the orifice face from the top to the bottom, and which belong to the same pair, are indicated as the first discharge opening 4 and the second discharge opening 5.

Also, it is assumed that the center of the first discharge opening 4 positioned on the orifice face is defined as the origin (0, 0), and the central axis of the first discharge opening 4 is defined as the axis Y, and that the axis perpendicular to the axis Y, which intersects the central axis of the second opening 5, is defined as the axis X. The angles formed by the perpendiculars to the discharge opening surface, the central axis of the first discharge opening 4, and the central axis of the second discharge opening 5 are defined as $\theta_1$, and $\theta_2$, respectively. The radius of the ink droplet discharged from the first discharge opening 4 is defined as $r_1$, and the radius of the ink droplet discharged from the second discharge opening 5 is defined as $r_2$. In other words, the axis X is equivalent to the axis in the direction from the top to the bottom on the orifice face, and the axis Y is the axis directed from the first discharge opening 4 to an object, such as a printing medium.

Here, in FIG. 5, the orifice face and the object 19 are in parallel to each other. Therefore, the $\theta_1$ and $\theta_2$ may be regarded also as the angles formed by the perpendiculars to the impact positions on the object and the central axis of the first discharge opening 4 and the central axis of the second discharge opening 5. Also, the $\theta_1$ and $\theta_2$ may take a range of $-90° < \theta_1, \theta_2 < 90°$. However, in each of the following expressions, the examination is carried out within a range of $0° \leqq \theta_1 < \theta_2 < 90°$ to make understanding easier based upon the corresponding representation made in FIG. 5.

Under conditions described above, given the center-to-center dimension of the first and second discharge openings (the distance between discharge openings) as $L_1$ and the distance between the head and the object as $h_1$, the distance ΔL (deviation of impact positions) between the intersection point Q of the central axis of the first discharge opening and the object, and the intersection point R of the central axis of the second discharge opening and the object is obtainable by the following expression:

$$\Delta L = h_1(\tan\theta_2 - \tan\theta_1) - L_1 \quad (1)$$

Here, if a gradation recording or the like is performed in particular, the shootings may be made in some cases from each of the first and second discharge openings individually to the object, respectively. Therefore, although depending on the processing method of images, the above-mentioned $\Delta L$ should be less than the dot pitches of a desired image density or should preferably be less than ½ or more preferably less than ⅓.

In this respect, the center of the droplet actually discharged may deviate from the central axis of its discharge opening in some cases. However, within the range of $0° \leqq \theta_1 < \theta_2 < 90°$, there is an advantage that the influence of deviation exerted by the droplet discharged from the first discharge opening, which is faster than the droplet discharged from the second discharge opening, is made smaller than when the condition is set at $\theta_1 > \theta_2$. As described later, therefore, this conditional arrangement is desirable, because if the momentum of the first droplet is larger than that of the second droplet, it becomes possible to make the deviation of impact positions smaller still when these droplets are combined. Also, this arrangement is desirable, because the angular difference between the $\theta_1$ and the $\theta_2$ is less than 90°, hence making the variation of the $\Delta L$ smaller than the case where the angular difference between the $\theta_1$ and the $\theta_2$ is in the range of 90° or more even if the droplets, which are actually discharged from each of the discharge openings, should deviate from the central axes thereof.

Now, in order to combine the two droplets reliably, it is desirable for the first and second droplets to be provided with an intersection region between the heads and the object.

Here, in FIG. 5, the diameter of each of the droplets is shown in the same diameter of each of the discharge openings, because FIG. 5 is a schematic view to be used only for illustration. However, when each of the droplets is discharged by means of a piezoelectric device or by means of the bubble creation using an electrothermal transducing device, the diameter of discharged droplet is generally larger than that of the discharge opening. In this case, then, it becomes possible to deal with a slight variation of the discharge directions and speeds of droplets if an intersection region is provided for the projection surfaces themselves on the central axes of the respective discharge openings between the head and the object.

Further, in order to deal with the variation of the discharge directions and speeds of the droplets, it is desirable to arrange the central axes of the two discharge openings so as to intersect each other on one point between the head and the object as shown in FIG. 5. In this case, the following expression should be satisfied to allow them to intersect at one point P in FIG. 5:

$$\Delta L = h_1(\tan\theta_2 - \tan\theta_1) - L_1 \geqq 0 \quad (2)$$

In this case, the impact position of the droplet on the object 19, which has been created by the combination of the two droplets, should be on the line segment that connects Q and R (at S in FIGS. 6A to 6D) irrespective of the size of each of the two droplets and the discharge speeds without any consideration given to the variation of the discharge directions. Therefore, the differences between the impact position of the combined droplet and the impact positions of the first droplet and second droplets discharged as individual ones is smaller than $\Delta L_1$, respectively. As a result, if the $\Delta L$ is less than the dot pitches of a desired image density, the differences between the impact of the combined droplet and the impact positions of the first and second droplets discharged as individual ones, respectively, becomes smaller than the dot pitches, hence making it possible to perform a gradation recording in high precision.

Here, in the usual range of the fields that adopt the liquid jet recording, there should exist each of the suitably applicable ranges at the $L_1$ and $h_1$ used for the above-mentioned expression (1) in order to obtain each impact in the desired position on the object precisely.

In other words, it is desirable to set the distance $h_1$ between the head and the object within a range of more than 0.2 mm and less than 3 mm in consideration of the fact that the object may be in contact with the head in the area where such region is less than 0.2 mm, particularly when the object is a paper sheet or the like which may be affected by the creation of cockling, and that if the distance is more than 3 mm, the influence exerted by the variation of discharge directions of droplets become greater.

On the other hand, as to the distance $L_1$, there is favorably no need for making the $\theta_1$ of the smaller one larger than the $\theta_2$. However, in consideration of the condition of head manufacture, it is difficult to produce the head in a size of less than 15 $\mu$m for the one that utilizes the electrothermal transducing device (in the case of the one that utilizes piezoelectric device such as piezo dives or the like, it is difficult to produce it in a size of less than 0.5 mm). Then, if the head is produced in a size of more than 3 mm, it becomes necessary to make the $\theta_2$ larger than the $\theta_1$ within the range of $h_1$ described above, leading to the greater influence of the variation of the discharge directions of droplets. Taking these facts into consideration, it is desirable to make this distance within a range of more than 15 $\mu$m and less than 3 mm. In this respect, as means for discharging droplets, it is desirable to utilize the electrothermal transducing devices than the piezoelectric ones such as piezo elements or the like, because with the electrothermal transducing devices, the $L_1$ can be made smaller to control the influence that may be exerted by the variation of discharge directions of droplets more favorably.

Now, in conjunction with FIGS. 6A to 6D, the description will be made of the combination of the two droplets. FIGS. 6A to 6D are the time series representation that illustrates each state of the two droplets being combined as described in conjunction with FIG. 5. The same reference marks are applied to the portions that shared by FIG. 5 in the description given below.

Figure 6A:
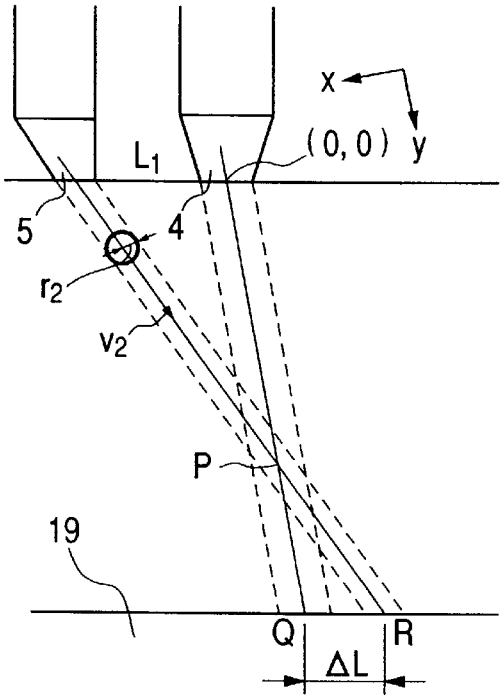
FIGS. 6A, 6B, 6C and 6D are views which illustrate the states of two droplets being combined as time elapses in accordance with the method represented in FIG. 5.
Figure 6B:
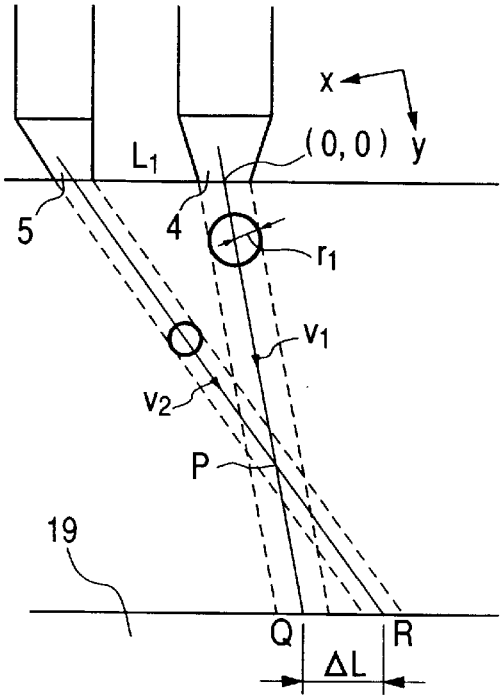
Figure 6C:
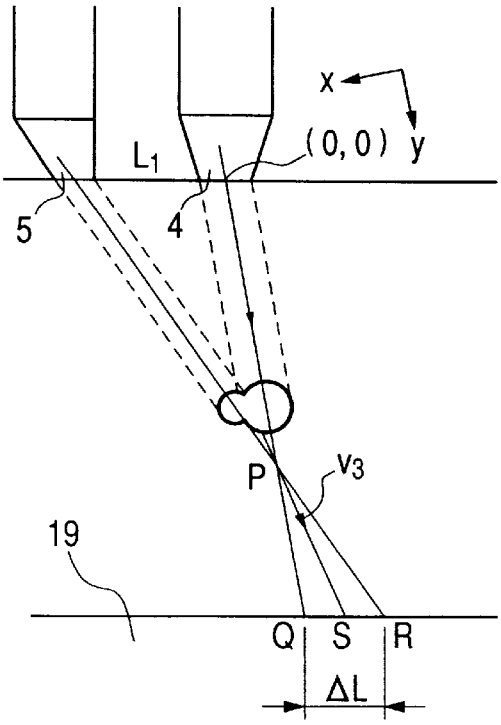
Figure 6D:
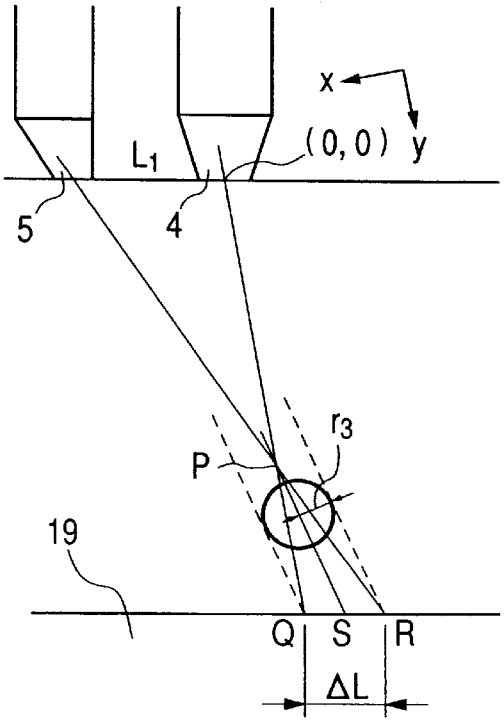

At first, as shown in FIG. 6A, the second droplet having the radius $r_2$ is discharged from the second discharge opening at the discharge speed $V_2$ preceding the droplet to be discharged from the first discharge opening. Then, with use of the driving circuit and others described earlier, the droplet having the radius $r_1$ is discharged from the first discharge opening at the discharge speed of $v_1(v_1 > v_2)$ with a delay $\delta T$ after the droplet has been discharged from the second discharge opening at the discharge speed of $v_2$ as shown in FIG. 6B. Then, as shown in FIG. 6C, the two droplets are combined on the intersection region of the loci thereof. After the combination, the droplet which shows almost sphere having the radius of $r_3$ moves at the speed of $v_3(v_1 < v_3 < v_2)$ so that the center thereof intersects the point S on the straight line between Q and R on the object 19.

In accordance with the present invention, the time differential $\delta T$ is set between the two droplets discharged from the two discharge openings, and then, the discharge speed is made faster for the droplet to be discharged later. Therefore, by setting the time differential $\delta T$ appropriately, it is made easier to set condition for the speeds at which two droplets are discharged from the two discharge openings in order to combine them as more than when the condition should be set to discharge droplets at the same time. In this way, it becomes possible to provide a liquid jet apparatus and a liquid discharge method, which are capable of dealing with a slight variation of the speeds of liquid discharges.

Further, by making the speed faster for the first droplet which is discharged later, the momentum of the first droplet becomes greater than that of the second droplet. As a result, the impact position S on the object after the droplets have been combined is made closer to the impact position Q which the first droplet is supposed to arrive at if discharged to the object independently. In this case, if the discharge amount of the first droplet (mass) $w_1$ is made larger than the discharge amount of the second droplet $w_2$, it is desirable, because, then, the momentum of the first droplet can be made greater than the momentum of the second droplet. Here, the impact position of the combined droplet may be deviated from the designated position due to the variation of the discharge speeds and directions of each of the droplets. Then, such deviation should be affected greater by the variation of the discharge speed and direction of the first droplet.

In accordance with the present invention, it is important to obtain an appropriate 8T in accordance with the $v_1$ and $v_2$. The range of this δT is defined by seeking the condition δT so that a t should be present in order to make the center-to-center distance between the droplets smaller than the sum of the radii thereof, provided that the central positions of the droplets are given as t and δT, respectively. Now, this range of δT can be expressed as given below using the $h_1$, $L_1$, $\theta_1$, and $\theta_2$ shown in FIG. 5.

$$\max\left(0,\ \frac{-L_1(v_1\cos\theta_1 - v_2\cos\theta_2) + (r_1+r_2)\sqrt{v_1^2+v_2^2-2v_1v_2\cos(\theta_1-\theta_2)}}{v_1v_2\sin(\theta_1-\theta_2)}\right) \le \delta T \le \frac{-L_1(v_1\cos\theta_1 - v_2\cos\theta_2) - (r_1+r_2)\sqrt{v_1^2+v_2^2-2v_1v_2\cos(\theta_1-\theta_2)}}{v_1v_2\sin(\theta_1-\theta_2)} \tag{3}$$

where the $r_1$ and $r_2$ are the radii of the first and second droplets, respectively.

The minimum value and the maximum value of the δT of the expression (3) are expressed by the time differential between discharges of droplets in order to allow them to be in contact with each other in the farthest region and the nearest region from the object, among the areas where the two droplets defined by the $v_1$, and $v_2$ may intersect each other (areas being partially aggregated by the intersection regions of the loci of the two droplets).

Here, it is desirable to define the δT on the basis of the discharge speeds $v_1$ and $v_2$ of the first and second droplets so that each of them can pass the point P shown in FIG. 5, because, in this way, the two droplets can be combined reliably in most cases by minimizing the unfavorable event where the combination of the droplets may be disabled due to the variation of the discharge speeds and directions of each of them. In this case, the δT can be expressed by the expression given below using the $L_1$, $\theta_1$ $\theta_2$, $v_1$, and $v_2$ shown in FIG. 5.

$$\delta T = \frac{h_2}{v_2\times\cos\theta_2} - \frac{h_2}{v_1\times\cos\theta_1} = \frac{L_1}{\tan\theta_2-\tan\theta_1}\left(\frac{1}{v_2\times\cos\theta_2} - \frac{1}{v_1\times\cos\theta_1}\right) \tag{4}$$

Now, in accordance with the liquid discharge method described above, given the discharge speed as v, a slight variation may take place in the actual speed of droplets to be discharged from the discharge opening. More specifically, when droplets are discharged by the creation of bubbles in liquid by means of the electrothermal transducing device, approximately 80% of all the discharged droplets are within a variation range of ±5% of a specific speed. Therefore, it is desirable to satisfy the following condition; in other words, the actual discharge speed of the fist droplet is faster than the second droplet even when the second droplet whose discharge speed is slower is made faster by 5%, while the first droplet whose discharge speed is faster is made slower by 5%:

$$\frac{v1}{v2} > \frac{1.05}{0.95} \cong 1.10 \tag{5}$$

Also, if a range is ±10%, approximately 98% are within this range of a specific speed. Therefore, it is more desirable to satisfy the following condition; in other words, the actual discharge speed of the fist droplet is faster than the second droplet even when the second droplet whose discharge speed is slower is made faster by 10%, while the first droplet whose discharge speed is faster made slower by 10%:

$$\frac{v1}{v2} > \frac{1.1}{0.9} \cong 1.22 \tag{6}$$

On the other hand, although the above-mentioned expressions (5) and (6) provide condition with respect to the speed rate of the two droplets, the upper and lower limits should be set for the speeds themselves. In other words, if the discharge speed is too low, the stability is made lower. Also, if it is too fast, the droplets tend to rebound when impacted on the surface of paper sheet or other object, and cause the image quality to be degraded. With these facts taken into consideration, it is desirable to satisfy the following formula for the $v_1$ and $v_2$:

$$5\ \text{m/sec.} < v_2 < v_1 < 22\ \text{m/sec.} \tag{7}$$

Further, in order to effectuate actual discharges in good precision, there exist the restrictions as to the $h_1$, $L_1$, $\theta_1$, and $\theta_2$ with respect to the ΔL expressed by the aforesaid expression (1). Therefore, in consideration of such restrictions, it is possible to define the condition, in which the droplets are combined assuredly at the discharge timing given by the expression (4) even when the two droplets have the same speed variation α (5% or 10%, respectively, for instance), by seeking a condition so that the t is present to make the center-to-center distance of the two droplets smaller than the sum of the radii thereof, provided that the central position of each of the droplets is given as the t, while the speed variation being taken into consideration. This condition is the ratio of the $v_1$ to $v_2$ to be expressed in the following formula:

$$\frac{v1}{v2} > f(\theta_i, r_i, L_1, \alpha) \quad (8)$$

$$(i = 1, 2)$$

Here, the value of $f(\theta_i, r_i, L_1, \alpha)$ becomes smaller, if $r_1$ and $r_2$ are larger, the angular difference between the $\theta_1$ and $\theta_2$ is larger, the $L_1$ is smaller, and the speed variation a is smaller.

Now, therefore, it is attempted to obtain the minimum value of the f within the range that satisfies every condition when the distance $L_1$ between the discharge openings is set at 15 μm, and each of the first and second droplets is defined as 80 pl, with the result that the minimum value is obtainable when $\theta_1$=0° and $\theta_2$=5.7°. These values provide f≅1.56 when the speed variation is 5%, and f≅1.91 when the speed variation is 10%.

Then, for a more practicable range, it is desirable to satisfy the formula (7) and the following formula (9) in order to obtain the range of the $v_1$ and $v_2$ where the droplets can be combined reliably even if the speed variation is taken into consideration with respect to the approximately 80% of all the droplets to be discharged:

$$\frac{v1}{v2} > 1.56 \quad (9)$$

Also, it is equally desirable to satisfy the formula (7) and the following formula in order to obtain the range of the $v_1$ and $v_2$ where the droplets are combined reliably even if the speed variation is taken into consideration with respect to the approximately 98% of all the droplets to be discharged:

$$\frac{v1}{v2} > 1.91 \quad (10)$$

Now, in consideration of the aspects described above, the range of each of the discharge speeds should be set at 5 to 11 m/sec on the lower side, and 8 to 22 m/sec on the higher side.

Here, the description has been made of the case of ($\theta_1<\theta_2$) where the distance to the point of the two droplets being combined from the first discharge opening is shorter than the distance to the point of the two droplets being combined from the second discharge opening. However, in the reverse case, that is, ($\theta_1>\theta_2$) where the distance from the first discharge opening to the combination point of the two droplets is longer, each of the conditional expressions given above is still applicable in the form different therefrom accordingly with the function of θ, v. In this case, however, the $v_1/v_2$ should be made greater than the case described earlier.

Also, in accordance with the above description, the central axes of the two discharge openings can form one plane, and at the same time, the surface of discharge openings and the object are in parallel with each other. Then, the present invention makes it possible to admit of a slight deviation resulting from the manufacture of heads and recording apparatuses as to the geometrical conditions which are the premises upon which the above description is set forth.

Now, the description that has been made in conjunction with FIGS. 5, 6A, 6B, 6C and 6D will be further described in accordance with the specific examples that may satisfy each of the conditions set forth above.

(Embodiment 1)

This embodiment shows an example of a head which satisfies a condition with regard to ΔL among the above mentioned condition.

The mode shown in FIG. 5 is prepared by use of piezo elements as means for discharging droplets. With the $L_1$=2 mm, the distance to the paper sheet is set at 1.2 mm. Then, it is confirmed that the two droplets are combined before being impacted on the object by means of the head provided with the $\theta_1$=0, and the $\theta_2$=59.1°. In this case, it is also confirmed that the deviation between the impact position of the combined droplet and the impact positions of each of the droplets is controlled within ⅓ or less of the dot pitches of 70.5 μm in the pixel density of 360 dpi. Then, with the distance to the paper sheet of 0.5 mm and 2.0 mm, it is confirmed that with the $\theta_1$=14°, the two droplets are combined before being impacted on the object, and that the deviation of the impact positions can be controlled within ⅓ or less of the dot pitches of the pixel density of 360 dpi when the $\theta_2$ is set at 76.8° and 51.4°, respectively.

(Embodiment 2)

Figure 7:
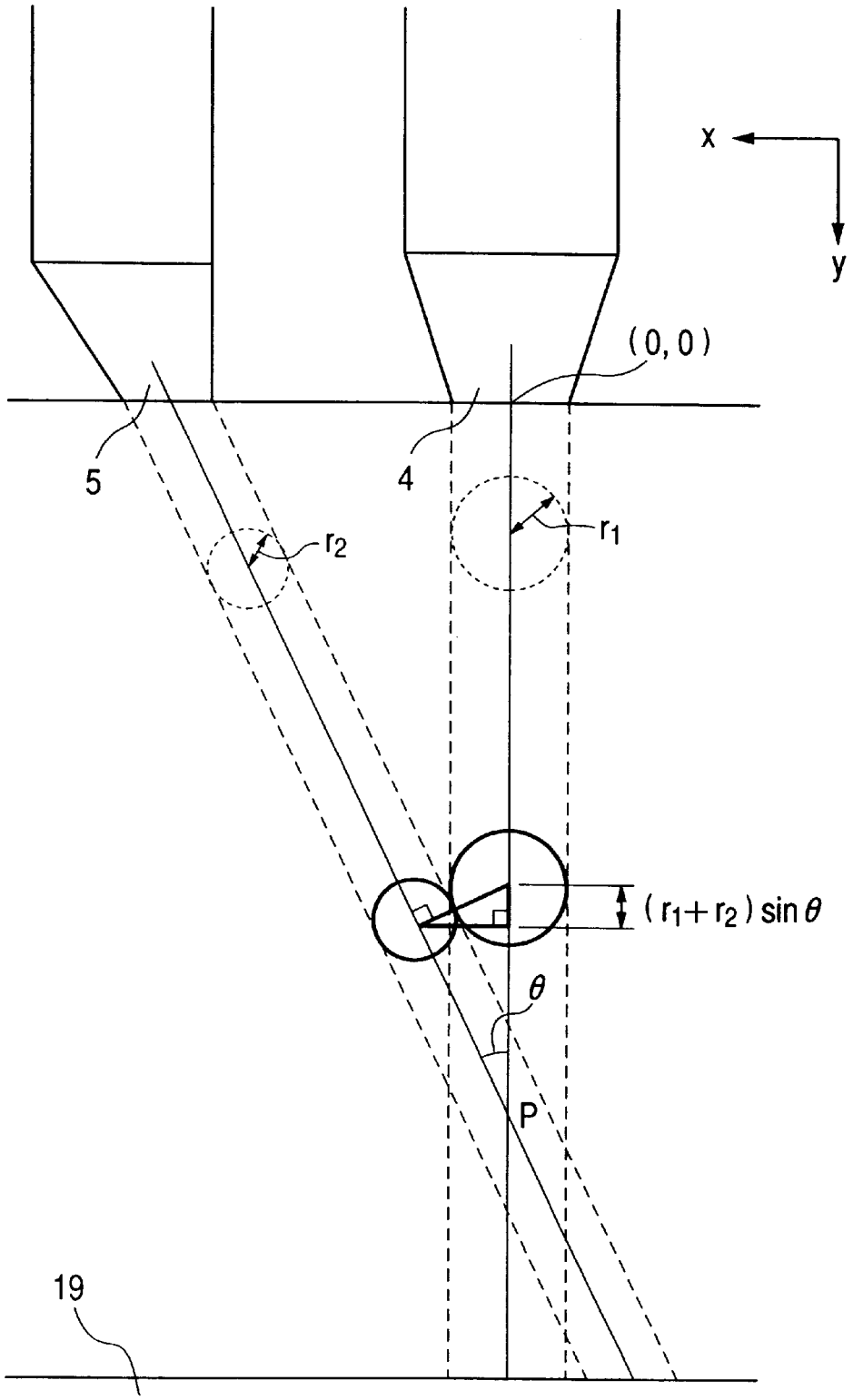
FIG. 7 is a view which illustrates the liquid discharge method in accordance with the present invention.

In accordance with the embodiment represented in FIG. 7, an example is shown in which two droplets can be combined reliably by the variation of discharge speeds when the angle of the first discharge opening shown in the embodiment represented in FIG. 5 is orthogonal to the object, that is, within the range that satisfies the condition as to ΔL, while setting $\theta_2$=0. Hereinafter, it is assumed that $\theta_1$=θ for the present embodiment.

In accordance with the present embodiment, the center-to-center distance is 38 μm between the first discharge opening 4 and the second discharge opening 5, while setting the angel θ at 3°, which is formed by the center axis of the first discharge opening 4 and the second discharge opening 5.

Then, ink having high density of colorant (dyes of approximately 5 w %) is supplied from the second common liquid chamber to the second liquid flow path 7, and the ink droplets are discharged from the second discharge opening 5 by applying electric pulses to the second heat generating device 3. On the other hand, it is arranged to supply the ink, which is provided with colorant of 1/16 of the density of ink to be supplied to the second liquid flow path 7, from the first common liquid chamber to the first liquid flow path 6, and then, by applying electric pulses to the first heat generating device 2, the ink droplets are discharged from the first discharge opening 4. The same kind of ink (colorant) and solvent that dissolves ink are used both for the first liquid flow path 6 and the second liquid flow path 7.

Here, the discharge amount (mass) of the ink droplet to be discharged from the first discharge opening 4, and the discharge speed are given as $W_1$ and $v_1$, respectively. The discharge amount of the ink droplet to be discharged from the second discharge opening 5 and the discharge speed are given as $W_2$ and $v_2$, respectively. In accordance with the present embodiment, as the nozzles for a first combination use, nozzles are prepared so as to discharge an ink droplet in the discharge amount $W_1$, of 24 ng at the discharge speed of $v_1$ is 18 m/sec, and an ink droplet in the discharge amount $W_2$ of 16 ng and at the discharge speed of 9 m/sec, and then, to allow them to collide with each other in the flight thereof. Also, as the nozzles for a second combination use, nozzles are prepared so as to discharge an ink droplet in the discharge amount $W_1$ of 33.3 ng and at the discharge speed $v_1$, of 16 m/sec, and an ink droplet in the discharge amount $W_2$ of 6.7 ng and at the discharge speed of 8 m/sec, and then, to allow them to collide with each other in the flight thereof. These nozzles are manufactured for use of one and the same liquid jet head. With the first combination nozzles, ink droplet is discharged from the second discharge opening 5 at first, and then, after 40.2 μsec since the ink droplet has been discharged from the second discharge opening 5, it is discharged from the first discharge opening 4. Meanwhile, with the second combination nozzles, the ink droplet is discharged from the second discharge opening 5 also at first, and then, after 45.2 μsec, it is discharged from the first discharge opening 4.

Further, as the nozzles that do not discharge any colliding ink droplets, nozzles are prepared each individually for the first discharge opening 4 and second discharge opening 5. The discharge amount of ink droplets and discharge speeds are set at 40 ng, and 14.5 m/sec, respectively, both for the discharge openings 1 and 2.

Both the first and second combination nozzles present the fluctuation of the discharge speeds within a range of ±6% to 8%. Here, with the arrangement of the structure described above, it is possible to allow the locus region of the ink droplet discharged from the second discharge opening 5 and the locus region of the ink droplet discharged from the first discharge opening 4 to collide with each other reliably to mix both ink droplets within the range of the intersection region even if the discharge speeds fluctuate approximately ±10%. The speed of the flight after collision is 14.4 m/sec for the first combination nozzles, and the 14.7 m/sec for the second combination nozzles.

Figure 8:
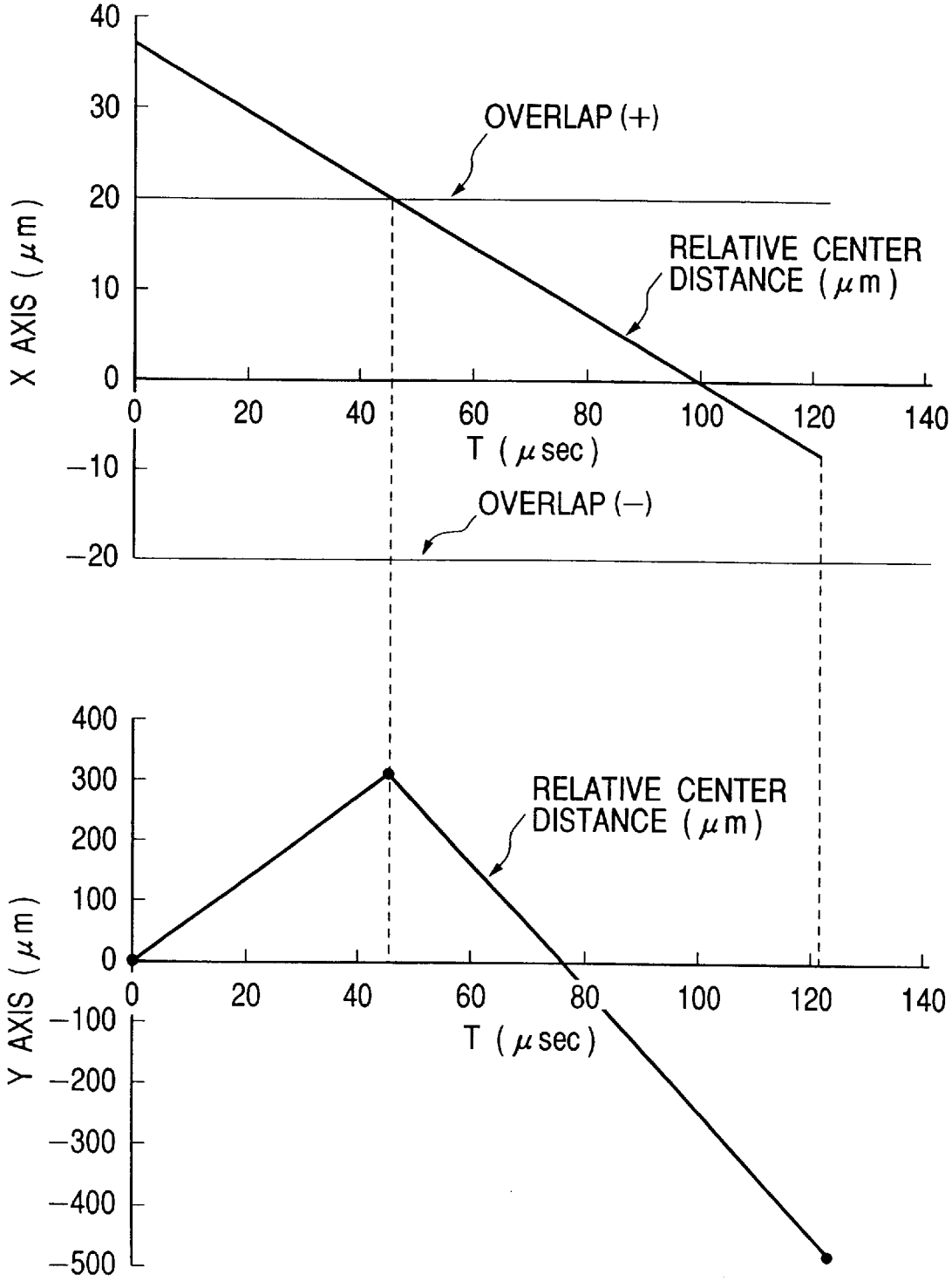
FIG. 8 is a graph which shows the relationship between the relative distances and the overlap periods of ink droplets.
Figure 9:
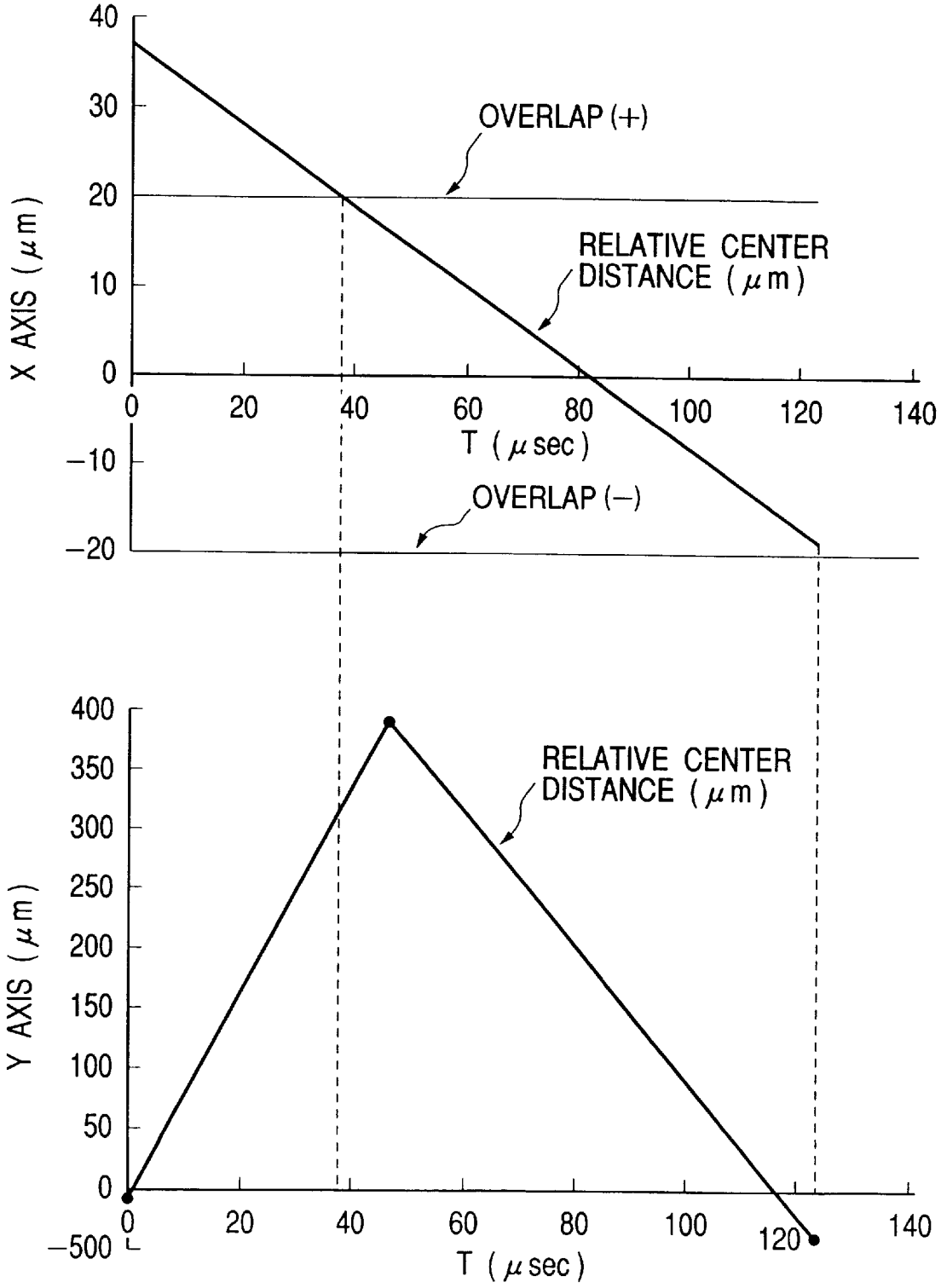
FIG. 9 is a graph which shows the relationship between the relative distances and the overlap periods of ink droplets.

FIG. 8 and FIG. 9 are graphs which illustrate the relationship between the relative distance between both ink droplets and the overlapping time T when ink droplets are discharged from both discharge openings 4 and 5 by use of the first combination nozzles. FIG. 8 shows the case where the discharge speed $v_1$ is increased by 10%, while the discharge speed $v_2$ is decreased by 10% from the numerical values described above. FIG. 9 shows the case where the discharge speed $v_1$ is decreased by 10%, while the discharge speed $v_2$ is increased by 10%. To show the above conditions in accordance with FIG. 8 and FIG. 9, the intersection range on the y–t graph is represented in the elliptical region formed by the combination of the two secondary curves passing the $y=\pm(r_1+r_2)$, provided that each axis is y=0, and $t=t_3$. However, in FIG. 8 , this is omitted, but instead, with respect to the direction of Y axis, it is verified that both ink droplets are combined when the center-to-center distance of each ink droplet becomes 0 in the overlapping time on the axis x (which of course corresponds to the above-mentioned elliptical region).

Figure 10:
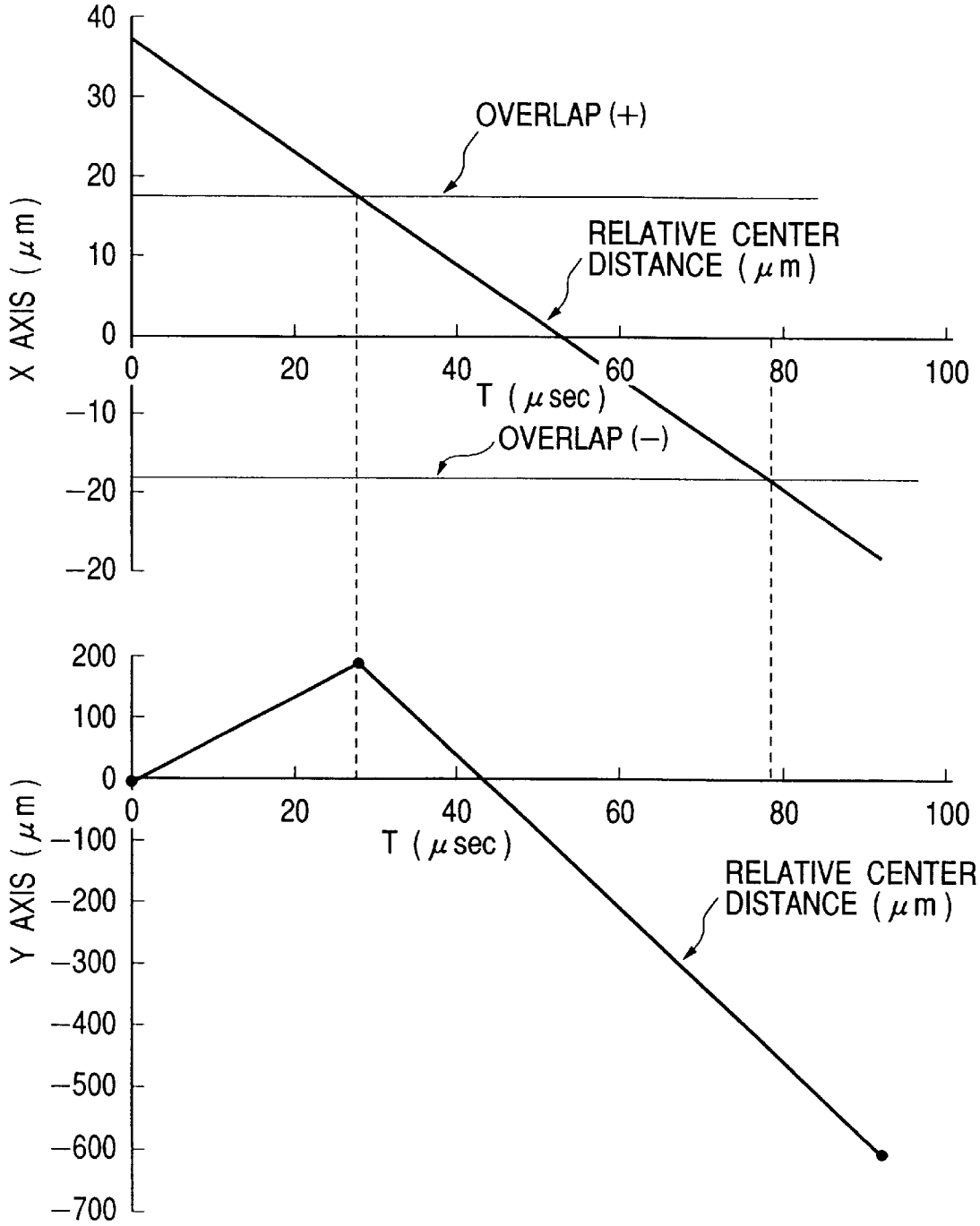
FIG. 10 is a graph which shows the relationship between the relative distances and the overlap periods of ink droplets.
Figure 11:
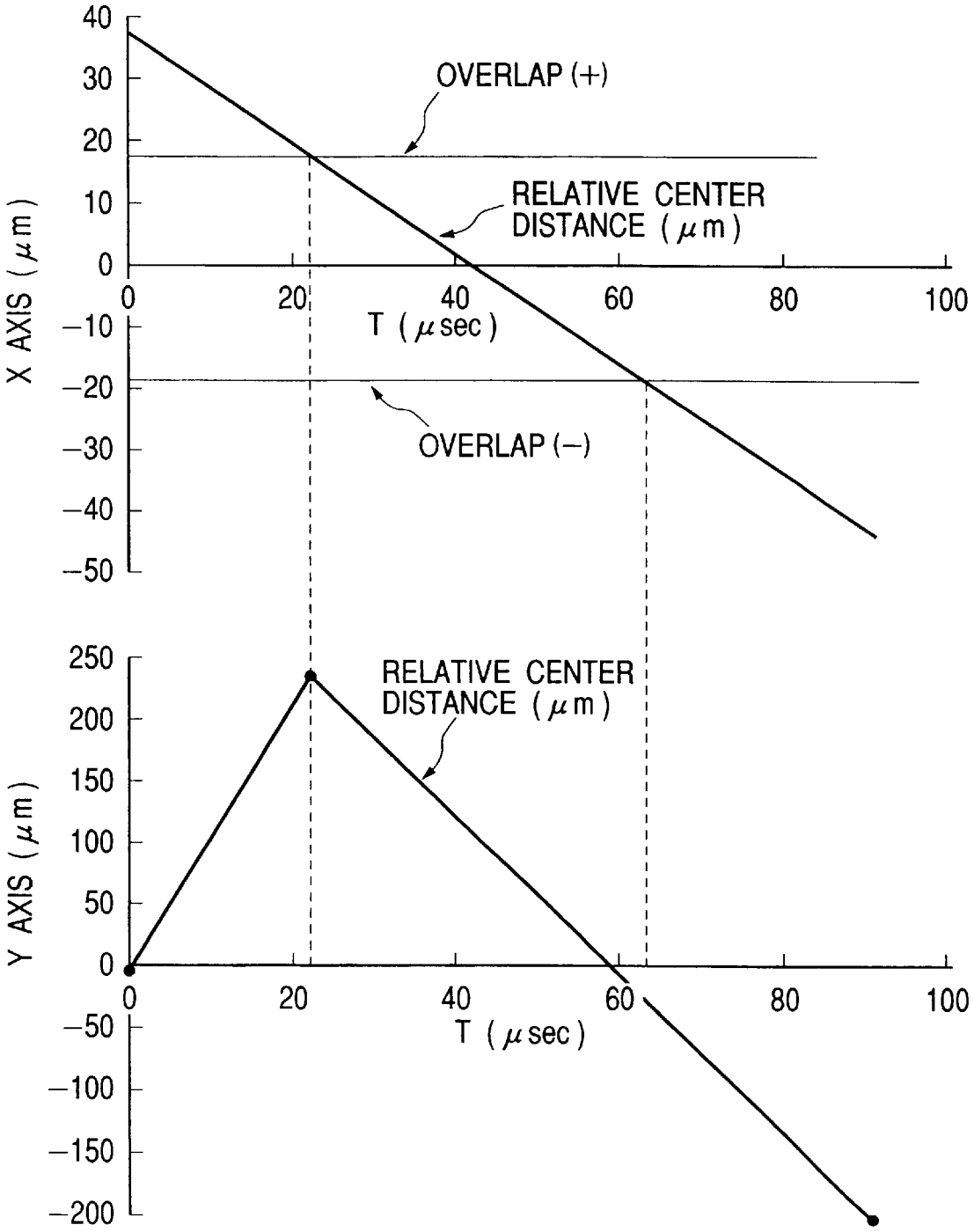
FIG. 11 is a graph which shows the relationship between the relative distances and the overlap periods of ink droplets.

Likewise, FIG. 10 and FIG. 11 are graphs which illustrate the relationship between the relative distance between both ink droplets and the overlapping time T when ink droplets are discharged from both discharge openings 4 and 5 by use of the second combination nozzles. FIG. 10 shows the case where the discharge speed $v_1$ is increased by 10%, while the discharge speed $v_2$ is decreased by 10% from the numerical values described above. FIG. 11 shows the case where the discharge speed $v_1$ is decreased by 10%, while the discharge speed $v_2$ is increased by 10%. From FIG. 10 and FIG. 11, it is understandable that both ink droplets are combined by means of the nozzles of the second combination.

Now, the liquid jet head provided with the above-mentioned first and second combination nozzles is installed on an ink jet recording apparatus as the ink jet recording head therefor. Then, the distance between the paper sheet serving as the object and each of the discharge openings is set at 1.2 mm for printing with the pixel density of 360 dpi (360 dots per 25.4 mm). As compared with the case where printing is carried out only with ink having approximately 5% colorant density, the OD (optical density) becomes ¼ when only ink of 1/16 colorant density of that ink is used; the OD becomes ¾ by use of the first combination nozzles; the OD becomes ½ by used of the second combination nozzles. Then, an image is obtained with a weighted ordinate gradation. Also, as compared with the case where printing is made only by use of the first discharge opening 4, the deviation of the impact position of the ink droplet on the surface of the paper sheet is approximately 7 μm by use of only the first combination nozzles; approximately 3 μm by use of only the second combination nozzles; and approximately 27 μm by use of only the second discharge opening 5. In this respect, with the dot pitches being 70.5 μm for the pixel density of 360 dpi, it is possible to output gradation images without degrading the image quality.

(The Other Embodiments)

The description has been made of the embodiments of the principal part of the present invention so far. Now, hereinafter, the description will be made of the entire structure of the head which is applicable to the present invention, the method for manufacturing heads, the liquid jet head cartridge, the liquid jet apparatus, the recording system, the head kid, among some others.

(The Entire Structure of the Head)

Figure 12:
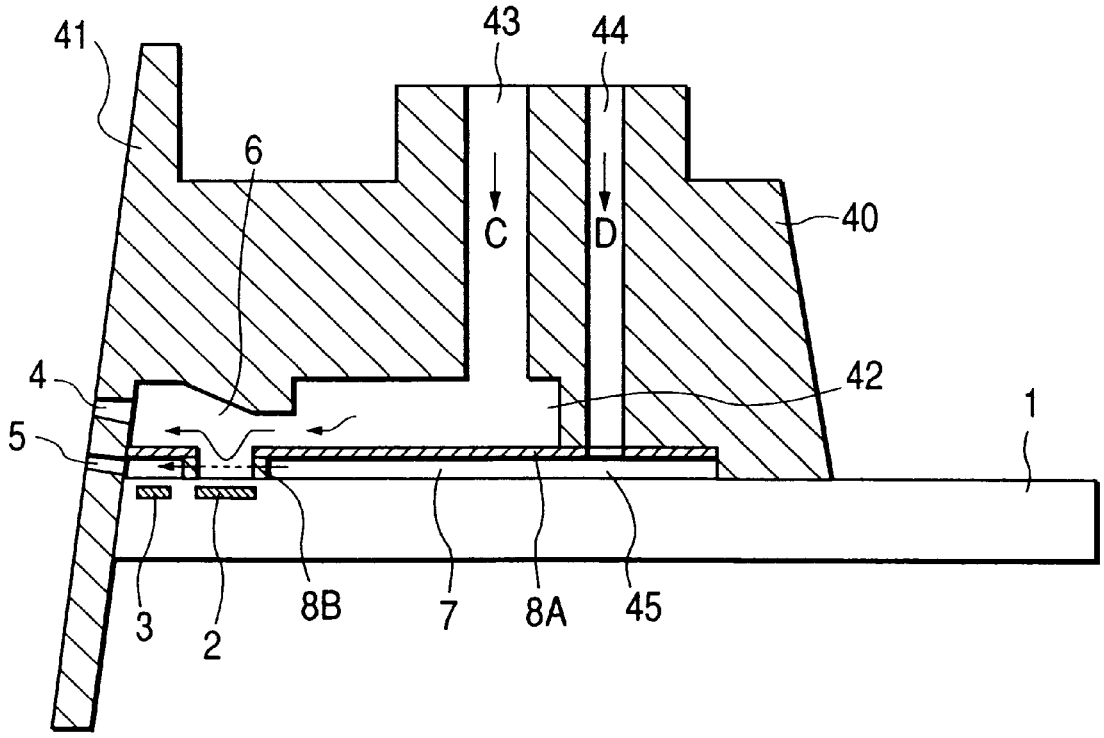
FIG. 12 is a vertically sectional view which shows the entire structure of a liquid jet head.

Now, hereunder, the description will be made of one example of the entire structure of a liquid jet head. FIG. 12 is a vertically sectional view which shows the entire structure of the liquid jet head.

In accordance with the embodiment represented in FIG. 12, the grooved member 40 briefly comprises an orifice plate 41 provided with a first discharge opening 4 and a second discharge opening 5 arranged in the direction perpendicular to the elemental substrate 1; a plurality of grooves (not shown) that form a plurality of the first liquid flow paths 6; and a recessed portion that forms the first common liquid chamber 42 conductively connected with and shared by the plural first liquid flow paths 6 in order to supply liquid to each of the first liquid flow paths. The elemental substrate 1 is the substrate having on it a plurality of electrothermal transducing devices for generating heat to create film boiling in liquid for the formation of bubbles in it.

On the lower side portion of this grooved member 40, a separation plate 8A is adhesively bonded. In this manner, a plurality of first liquid flow paths 6, which are conductively connected with the first discharge openings 4, are formed. This separation plate 8A is provided with apertures corresponding to the positions of the first heat generating devices 2 on the elemental substrate 1 to which this plate is bonded later. Further, On the lower side portion of the separation plate 8A, the elemental substrate 1 is bonded through the separation wall 8B that surrounds each of the first heat generating devices 2. In this manner, it is made possible to form each of the second liquid flow paths 7 which is conductively connected only with each of the second discharge openings 5, and which is arranged only with each second heat generating device 3 in the state of being completely separated from each of the first liquid flow paths 6. On the right side portion of the second liquid flow path 7 in FIG. 12, a second common liquid chamber 45 is made by a plurality of second liquid flow paths 7 being joined together for the formation thereof.

The grooved member 40 thus arranged is provided with a first liquid supply path 43 that reaches the interior of the first common liquid chamber 42 from the upper portion of the grooved member 40 for the supply of the first liquid. Also, the grooved member 40 is provided with a second liquid supply path 44 that reaches the interior of the second common liquid chamber 45 from the upper portion of the grooved member 40 through the separation plate 8A.

As indicated by an arrow C in FIG. 12, the first liquid is supplied to the first liquid common chamber 42 through the first liquid supply path 43, and then, supplied to the first liquid flow paths 6. Here, as indicated by an arrow D in FIG. 12, the second liquid is supplied to the second liquid common chamber 45 through the second liquid supply path 44 and then, supplied to the second liquid flow paths 7.

The second liquid supply path 44 is arranged in parallel with the first liquid supply path 43. However, the arrangement is not necessarily limited to this formation. If only the second liquid supply path is formed so that it can be conductively connected with the second common liquid chamber 45, the second liquid supply path may be arranged in anyway for the grooved member 40. Also, the thickness (diameter) of the second liquid supply path 44 is determined in consideration of the amount of supply of the second liquid. It is not necessarily to form this supply path circular, either. Rectangle or the like may be adoptable.

In accordance with the embodiment described above, it becomes possible to reduce the part numbers to make the time required for the manufacturing processes shorter, as well as to reduce the costs of manufacture, because the second liquid supply 44 to supply the second liquid to the second liquid flow paths 7 and the first liquid supply path to supply the first liquid to the first liquid flow paths 6 can be provided by the provision of one and the same grooved member 40.

Also, the structure is arranged so that the supply of the second liquid to the second common liquid chamber 45 is carried out by means of the second liquid supply path 44 arranged in the direction which penetrates the separation plate 8A that separates the first liquid and the second liquid. Therefore, bonding of the separation plate 8A, the grooved member 40, and the elemental substrate 1 is made in one process at a time, thus making it easier to fabricate them in a better bonding precision, which will contribute to excellent discharges of droplets eventually. Here, the second liquid is supplied to the second common liquid chamber 45 penetrating the separation plate 8A. This arrangement makes it possible to supply the second liquid to the second liquid flow paths 7 reliably, thus securing a sufficient amount of liquid to be supplied reliably for the execution of stabilized discharges.

(The Manufacture of the Liquid Jet Head)

Now, the description will be made of the manufacturing process of a liquid jet head represented in FIG. 12.

Here, briefly, the flow path wall of the second liquid flow path 7 and the separation plate 8B that surrounds the first heat generating device 2 are formed on the elemental substrate 1. The separation plate BA having the aperture on the position corresponding to the first heat generating device 2 is installed on the elemental substrate 1 thus arranged. Further on it, the grooved member 40 is installed with grooves and others that form the first liquid flow path 6 or a head is manufactured in such a manner that after the formation of the flow path wall of the second liquid flow path 7 on the elemental substrate 1, a separation member formed integrally with the separation wall 8B and separation plate 8A is installed on this flow path wall, and then, the grooved member 40 is bonded to it.

These manufacture methods will be described further in detail. FIGS. 13A to 13E are cross-sectional views which schematically illustrate the manufacturing processes of a liquid jet head when a separation plate 8A and separation wall 8B are used after each of them is prepared individually. FIGS. 14A to 14D are cross-sectional views which schematically illustrate the manufacturing processes of a liquid jet head using the separation member integrally formed by the separation plate 8A and the separation wall 8B.

Figure 13A:
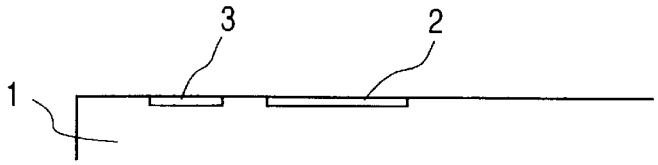
FIGS. 13A, 13B, 13C, 13D and 13E are views which schematically illustrate one example of the manufacturing process of the liquid jet head.
Figure 13B:
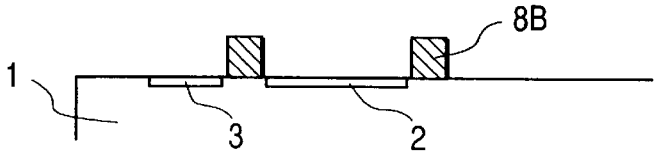
Figure 13C:
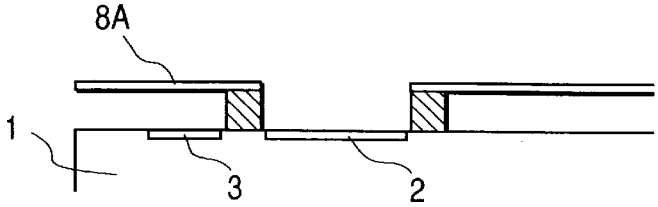
Figure 13D:
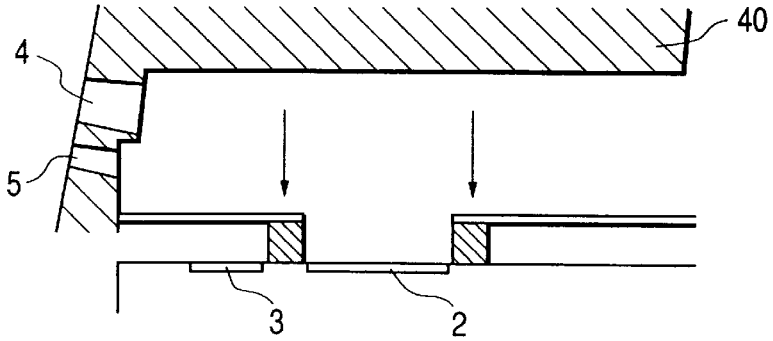
Figure 13E:
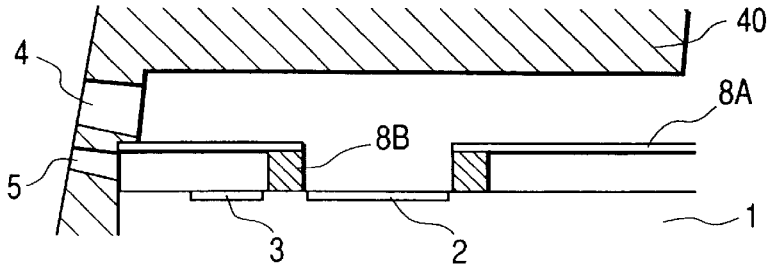
Figure 14A:
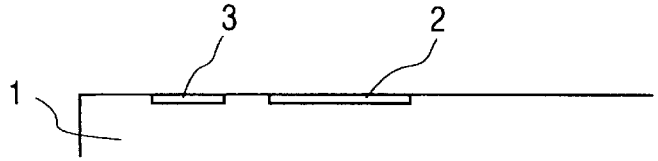
FIGS. 14A, 14B, 14C and 14D are views which schematically illustrate one example of the manufacturing process of the liquid jet head.
Figure 14B:
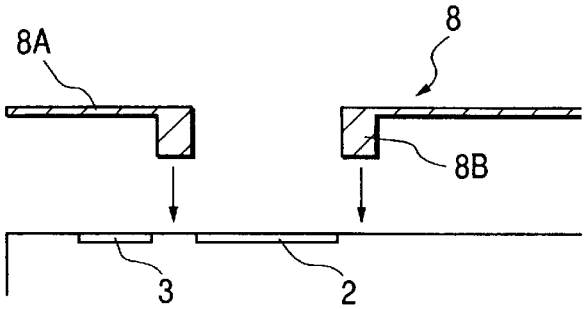
Figure 14C:
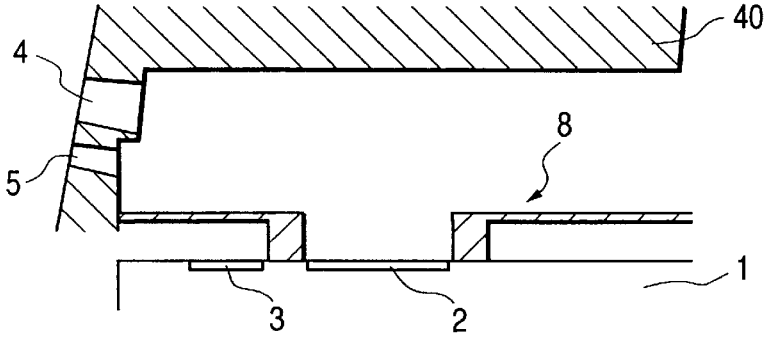
Figure 14D:
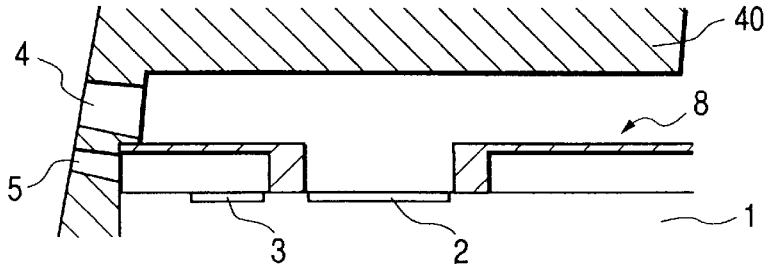

As shown in FIG. 13A, on the elemental substrate having the first heat generating device 2 and the second heat generating device 3 formed on it, the separation wall 8B is formed to surround the first heat generating device 2 as shown in FIG. 13B. After that, as shown in FIG. 13C, the separation plate 8A having a hole, which is open to the portion corresponding to the first heat generating device 2, is positioned, and then, it is bonded on the separation wall 8B. Lastly, the grooved member 40, which is provided with the first discharge opening 4, the second discharge opening 5, and the first liquid flow path wall (not shown) formed on it, is positioned. Then, the grooved member is bonded under pressure to the separation member formed by the separation plate 8A and the separation wall 8B, thus completing the liquid jet head.

In contrast to a method of manufacture of the kind, the one shown in FIGS. 14A to 14D makes it possible to eliminate the positioning and bonding processes of the separation plate 8A and separation wall 8B by using the separation member 8 instead, which is provided with the separation plate 8A and separation wall 8B integrally formed therefor. In this way, it becomes possible to materialize the enhancement of the production yield, and the reduction of costs at the same time.

(The Liquid Jet Head Cartridge)

Now, the description will be made briefly of a liquid jet head cartridge provided with the liquid jet head of the above embodiment which is mounted on it.

Figure 15:
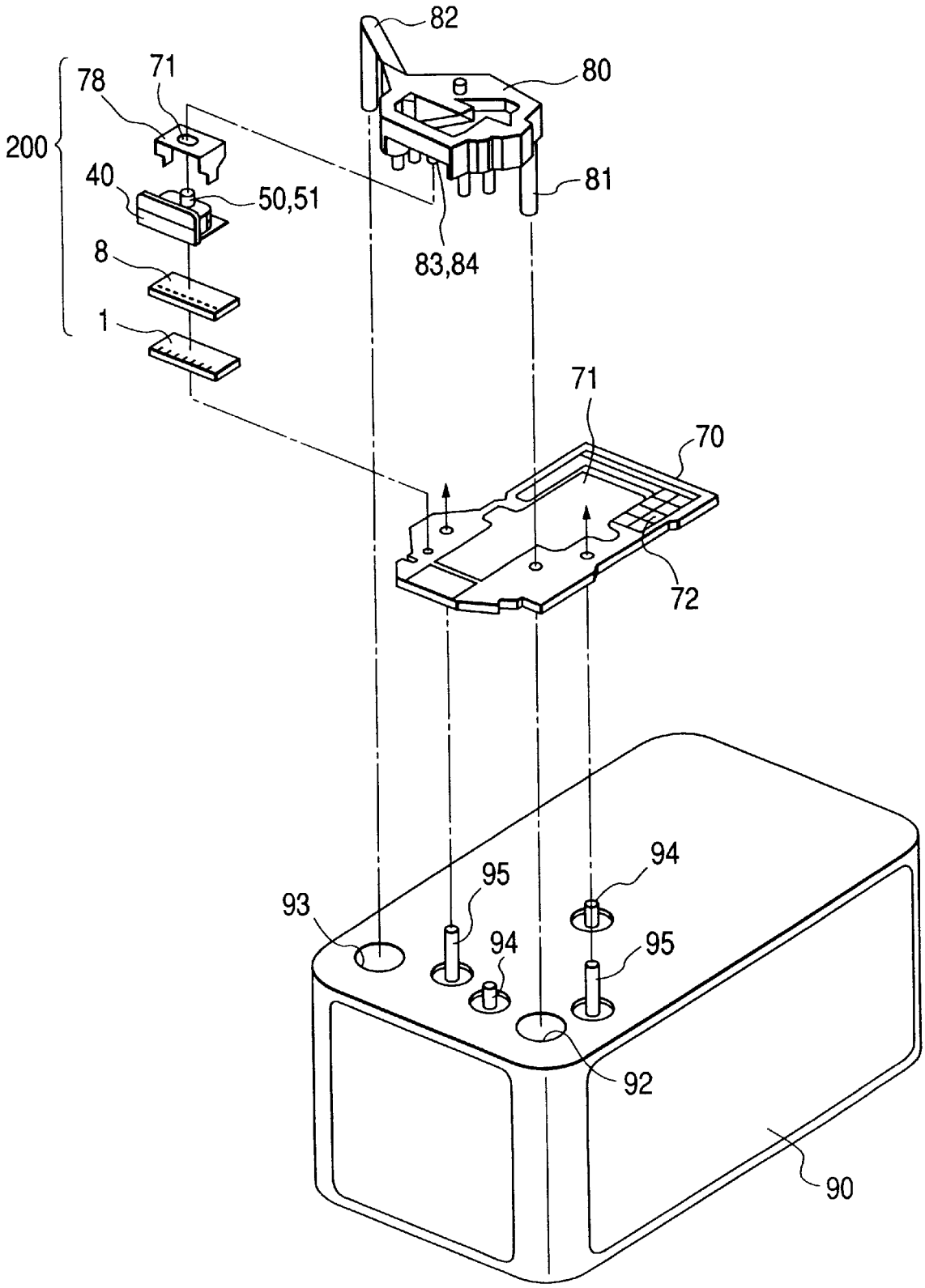
FIG. 15 is an exploded perspective view which shows a liquid jet head cartridge.

FIG. 15 is an exploded perspective view which schematically shows the liquid jet head cartridge including the liquid jet head described earlier. This liquid jet head cartridge is, briefly, formed by a liquid jet head unit 200 and a liquid container 80.

The liquid jet head unit 200 comprises an elemental substrate 1, a separation member 8, a grooved member 40, a pressure spring 78, a liquid supply member 90, and a supporting member 70, among some others. As described earlier, on the elemental substrate 1, a plurality of heat generating resistors (heat generating devices) are arranged in line, and also, a plurality of functional devices are arranged in order to drive these heat generating resistors selectively. The second liquid flow path is formed between this elemental substrate 1 and the separation member 8 as described earlier. The second liquid flows in this flow path. With the separation member 8 being bonded with the grooved member 40, the first liquid flow path is formed for the first liquid to flow. The pressure spring member 78 provides the grooved member 40 with biasing force acting in the direction toward the elemental substrate 1. With this biasing force, the elemental substrate 1, the separation member 8, and the grooved member 40, as well as the supporting member 70 which will be described later, are integrally formed together in good condition. The supporting member 70 supports the elemental substrate 1 and others. On this supporting member 70, there are further provided a contact pad 72 which is connected with the elemental substrate 1 to exchange electric signals with the printed-circuit board 71 that supplies electric signals, and which is also connected with the apparatus side to exchange electric signals with the apparatus side.

For the liquid container 90, the first liquid and the second liquid to be supplied to the liquid jet head, respectively, are retained in its interior separately. On the outer side of the liquid container 90, the positioning unit 94 and the fixing shafts 95 are provided for the arrangement of a connecting member that connects the liquid jet head and the liquid container 90. The first liquid is supplied to the liquid supply path 81 of the liquid supply member from the liquid supply path 92 of the liquid container 90 through the supply path 84 of the connecting member, and then, supplied to the first common liquid chamber by way of the discharge liquid supply paths 83, 71, and 72 of each of the members. Likewise, the second liquid is supplied to the liquid supply path 82 of the liquid supply member 80 from the supply path 93 of the liquid container 90 through the supply path of the connecting member, and then, supplied to the second common liquid chamber by way of the liquid supply paths 84, 71, and 72 of each of the members.

(The Liquid Discharge Apparatus)

Figure 16:
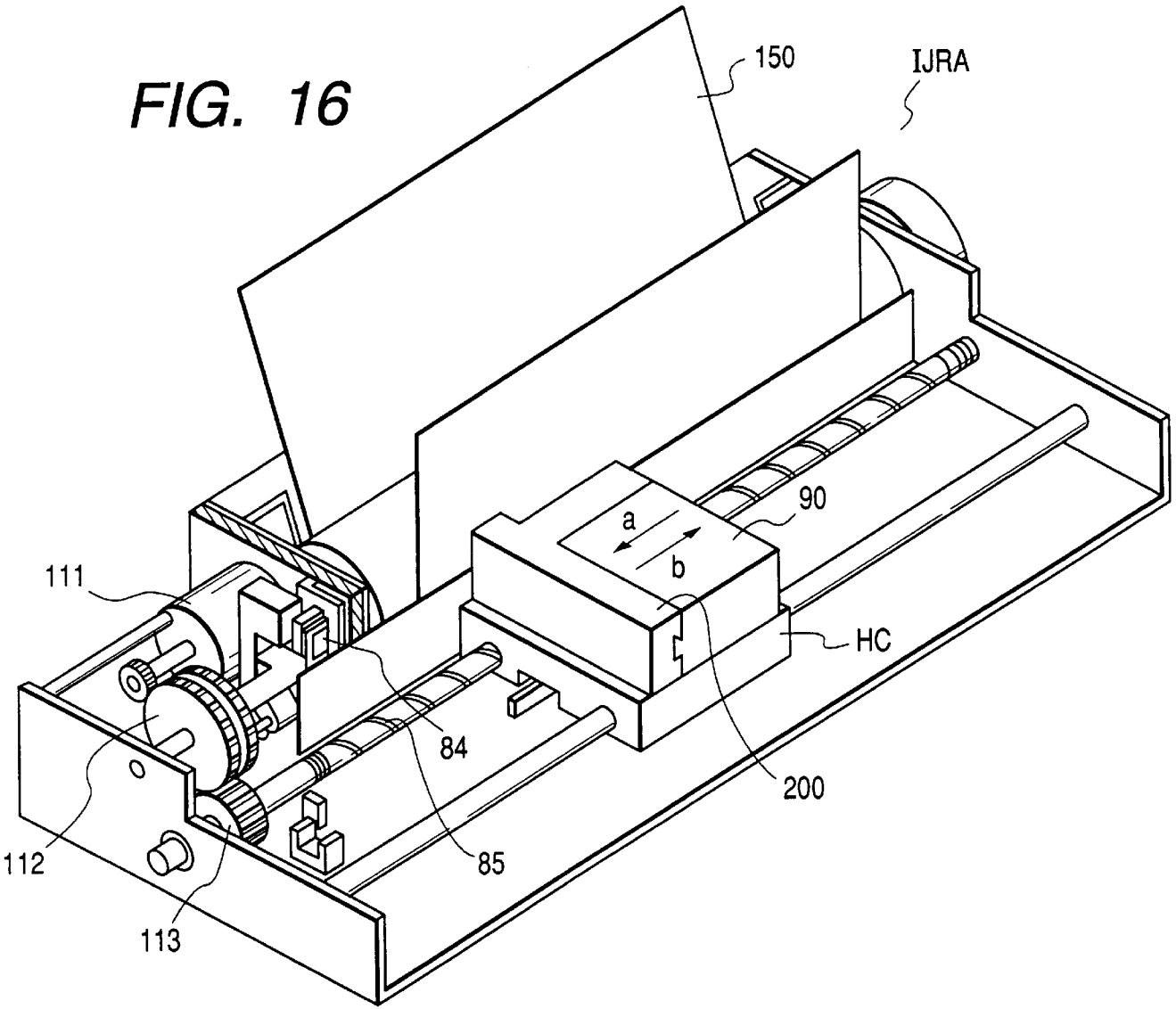
FIG. 16 is a perspective view which schematically shows the structure of a liquid jet apparatus.

FIG. 16 is a view which schematically shows the structure of a liquid jet apparatus having a liquid jet head mounted on it. Here, in particular, the description will be made of an ink jet recording apparatus IJRA that uses ink as the first and second liquids.

A carriage HC of the liquid jet apparatus (ink jet recording apparatus IJRA) mounts on it a detachable head cartridge structured by a liquid tank unit 90 that retains ink and a liquid jet head unit 200. The carriage reciprocates in the width direction of a recording medium 150, such as a recording paper sheet, which is carried by means of a recording medium carrier. When driving signals are supplied to the liquid jet head unit on the carriage HC from driving signal supply means (not shown), recording liquid is discharged from the liquid jet head to the recording medium in accordance with the driving signals. Also, this recording apparatus is provided with a motor 111 that serves as a driving source, gears 112 and 113, a carriage shaft 115, and others that are needed for transmitting the power from the driving source to the carriage. By use of this recording apparatus and the liquid discharge method adopted therefor, it is possible to obtain images recorded in good condition by discharging liquid to various recording media.

Figure 17:
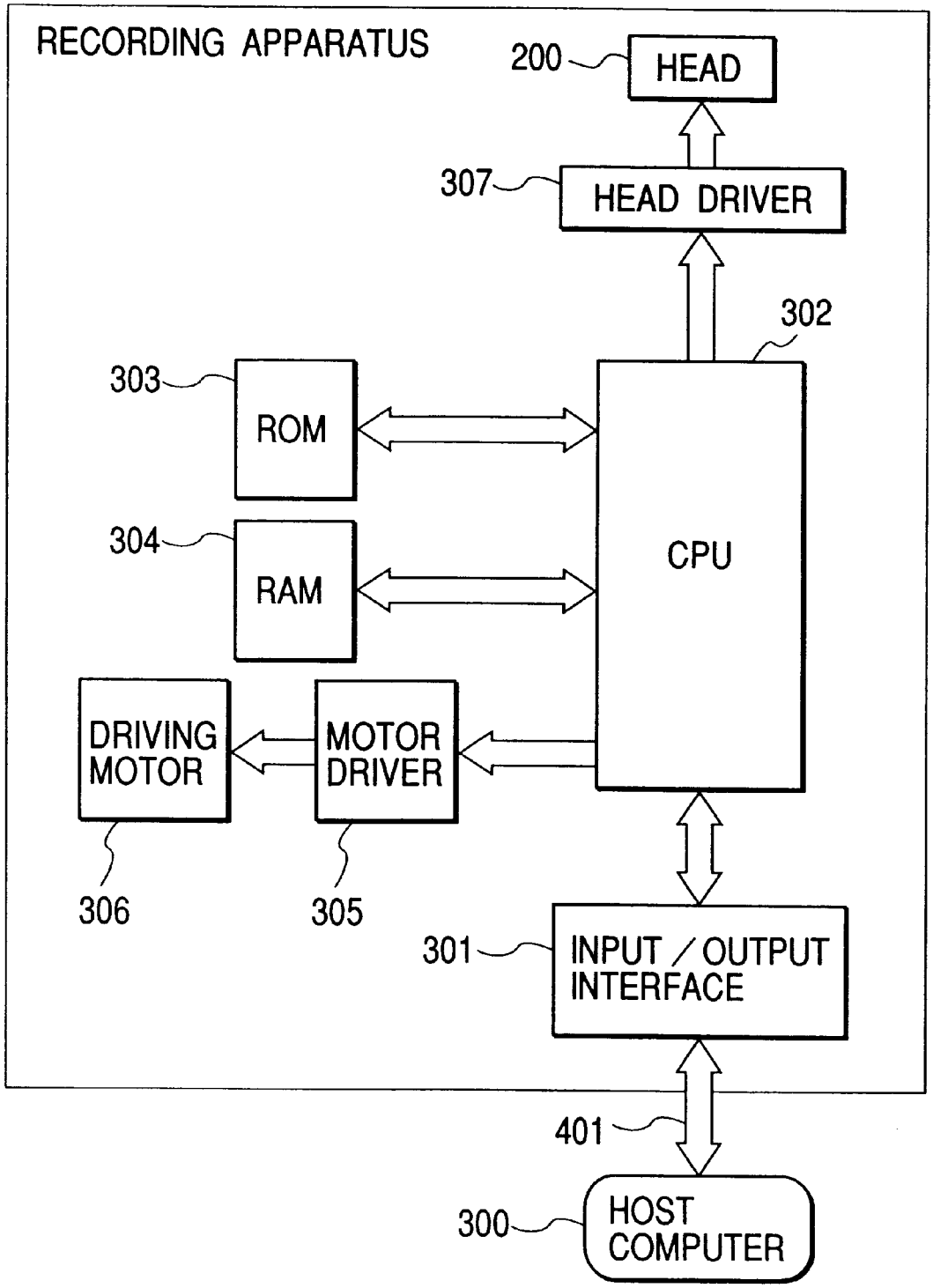
FIG. 17 is a block diagram which shows the circuit structure of the apparatus represented in FIG. 16.

FIG. 17 is a block diagram which shows the entire body of the recording apparatus that performs ink jet recording with the application of the liquid discharge method of the present invention.

This recording apparatus receives printing information from a host computer 300 as control signals. The printing information is provisionally held on the input interface 301 arranged in the interior of the recording apparatus. At the same time, the printing information is converted to the data executable by the recording apparatus, and inputted into the CPU 302 which dually serves as means for supplying head driving signals. On the basis of the control program stored on the ROM 303, the CPU 302 processes the data inputted to the CPU 302 using the RAM 304 and other peripheral units, thus converting them into the data to be printed (image data). Also, the CPU 302 produces the motor driving data to drive the driving motor to move the recording sheet and the recording head in synchronism with the image data thus produced. The image data and motor driving data are transmitted to the head 200 and the driving motor 306 through the head driver 307 and the motor driver 305, respectively. Then, with the controlled timing, the head and motor are driven so that images are formed.

As the recording media (objects) which are usable by a recording apparatus of the kind for the provision of ink or other liquids thereon, there may be named various kinds of paper and OHP sheets, plastic material usable for compact disc, ornamental board, or the like, textiles, metallic materials such as aluminum, copper, leather material such as cowhide, hog hide, or artificial leather, wood material such as wood or plywood, bamboo material, ceramic material such as tiles, or three-dimensional products such as sponge. Also, the above-mentioned recording apparatuses, there are included a printing apparatus that records on various paper and OHP sheets, a recording apparatus for use of recording on compact discs and other plastic materials, a recording apparatus for use of recording on metal, such as a metallic plate, a recording apparatus for use of recording on leathers, a recording apparatus for use of recording on woods, a recording apparatus for use of recording on ceramics, a recording apparatus for use of recording on a three-dimensional netting structure, such as sponge, and also, textile printing apparatuses that record on textiles. As the discharge liquid to be used for these liquid jet apparatuses, it should be good enough to use the liquid which matches each of the recording media and recording conditions.

In this respect, for the recording apparatuses described above, it is possible to make the deviation of impact positions smaller still by controlling the discharge timing appropriately in consideration of the scanning speeds if the nozzle arrangement of the first and second discharge openings and the scanning direction of the carriage are in agreement.

(Recording System)

Figure 18:
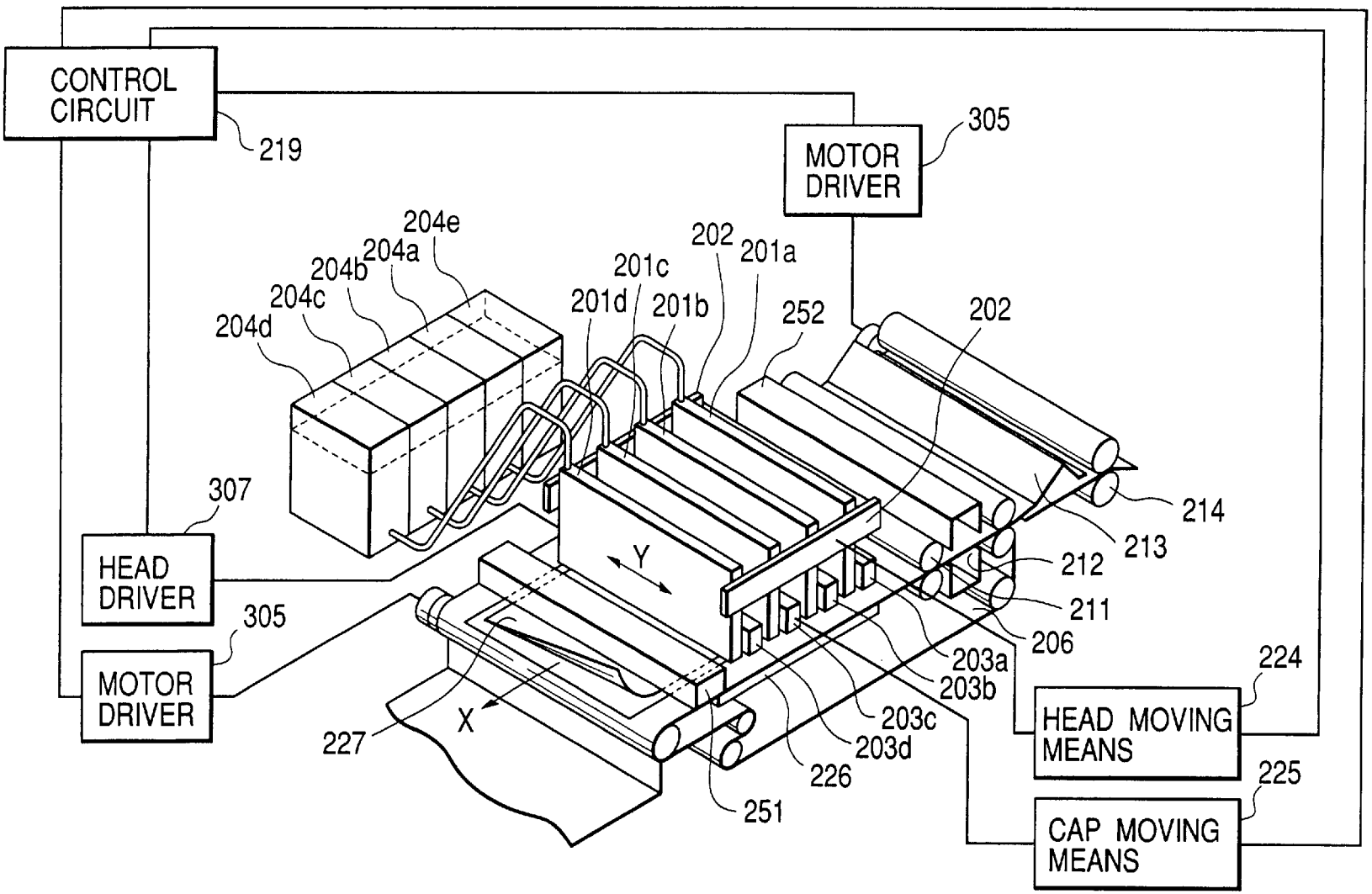
FIG. 18 is a structural view which shows an ink jet recording system.
Figure 19:
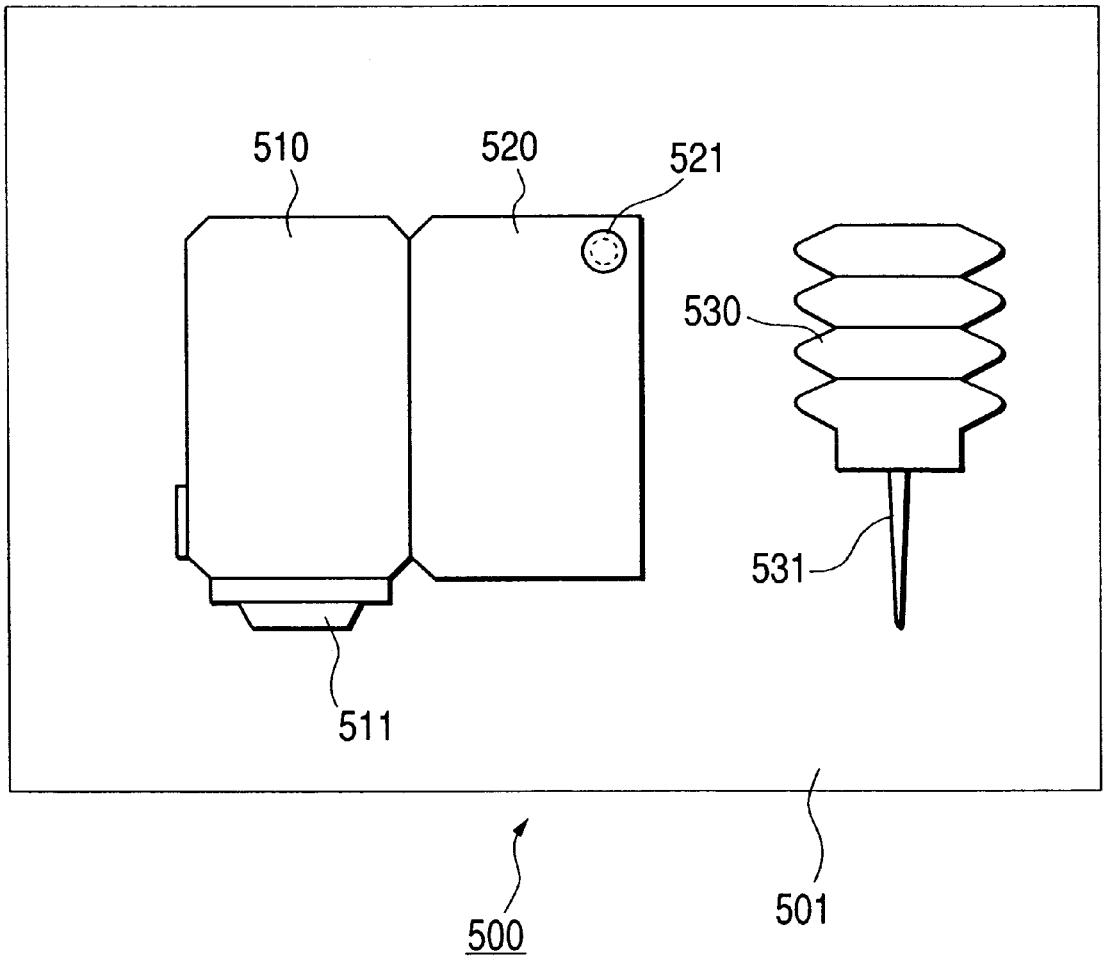
FIG. 19 is a view which schematically shows a head kit.

Now, the description will be made of one example of the ink jet recording system whereby to record on a recording medium using the above-mentioned liquid jet head as the recording head. FIG. 18 is a view which schematically illustrates the structure of this ink jet recording system.

The liquid jet head of this ink jet recording system is a full line type head where a plurality of discharge openings are arranged at intervals (density) of 360 dpi (per 25.4 mm) in a length corresponding to the recordable width of the recording medium 150. Four liquid jet heads 201*a*, 201*b*, 201*c*, and 201*d*, each for yellow (Y), magenta (M), cyan (C), and black (Bk) are fixed and supported by a holder 202 in parallel with each other at given intervals in the direction X. To these liquid jet heads 201*a* to 201*d*, signals are supplied from the head driver 307. On the basis of such signals, each of the liquid jet heads 201*a* to 201*d* is driven. For each of the liquid jet heads 201*a* to 201*d*, four color ink of Y, M, C and Bk are supplied from each of the ink containers 204*a* to 204*d* as the first liquid. Also, dilution (the second liquid) for use of the ink that serves as the first liquid is retained in the dilution container 204*e*. Then, the arrangement is made to supply it to each of the liquid jet heads 201*a* to 201*d*. Also, on the lower part of each of the liquid jet heads 201*a* to 201*d*, there is arranged each of the head caps 203*a* to 203*d* having in it a sponge or some other ink absorbent, respectively. When recording is at rest, each of the liquid jet heads 201*a* to 201*d* is covered with each of the head caps 203*a* to 203*d* in order to keep each of them in good condition.

Further, for this system, a carrier belt 206 is provided, which constitutes carrier means for carrying various kinds of recording media as described earlier. The carrier belt 206 is drown around a given path by means of various rollers, and driven by driving rollers connected with a motor driver 305.

Here, also, for this ink jet recording system, a preprocessing apparatus 251 and a postprocessing apparatus 252 are provided on the upstream and downstream sides of the recording medium carrier path in order to give various treatments to the recording medium before and after recording, respectively. The preprocess and postprocess are different in its contents depending on the kinds of recording media, and also, on the kinds of ink to be used. However, for the recording medium formed by metallic, plastic, or ceramic material, or the like, for example, ultraviolet and ozone irradiation are given as the preprocessing thereof. In this way, the surface of the recording medium is activated to implement the enhancement of ink adhesion. Also, for the plastic recording medium or the like, which tends to generate static electricity, an ionizer is used as a preprocessing device to remove the static electricity generated on the recording medium, because dust particles may easily adhere to the surface thereof, and such adhesion of dust particles may, in turn, hinder the normal performance of recording. Also, when textiles are used as a recording medium, it may be possible to provide textiles with a substance which is selective from among alkaline substance, water soluble substance, synthetic polymer, water soluble metallic salt, and thiourea with a view to enhancing the stain-resistance, the percentage exhaustion, or the like. The preprocessing is not necessarily limited to those mentioned here, but it may be possible to adopt a treatment that gives an appropriate temperature to a recording medium. On the other hand, the post-processing is such as to promote the fixation of ink by giving heat treatment, irradiation of ultraviolet rays, or the like to the recording medium on which ink has been provided, or such as to carry out a process to rinse away the processing agent that has adhered to the recording medium in the preprocessing but remains yet to be activated, among some others.

In this respect, the description has been made of the case where a full line head is used for the liquid jet head. However, the liquid jet head is not necessarily limited to the full line type. It may be possible to adopt a smaller liquid jet head described earlier, which is arranged to be in a mode that recording is performed by carrying the head in the width direction of a recording medium.

(Head Kit)

Now, hereunder, the description will be made of the head kit provided with the liquid jet head described above. FIG. 21 is a view which schematically shows such head kit.

This head kit is arranged to house, in the kit container 501, a liquid jet head 510 provided with an ink discharge unit 511 for discharging ink; an ink container 520, which is separable or inseparable from the liquid jet head 510; and ink filling means 530 retaining ink to be filled into the ink container 520. When ink has been consumed completely, the injection unit (injection needle and others) 531 of the ink filling means is partly inserted into the air communication opening 521 of the ink container 520, the connecting portion with the head, or the hole arranged to be open on the wall of ink container 520. Then, through such insertion part, ink in the ink filling means should be filled into the ink container.

In this way, the liquid jet head, the ink container, and the ink filling means are housed in one kit container. Thus, even when ink has been consumed completely, ink is easily filled in the ink container immediately as described above to make it possible to begin recording at once.

In this respect, the description has been made in assumption that the ink filling means is included in the head kit, but as a head kit, it may be possible to adopt a mode in which only a separable type ink container having ink already filled in it, and the liquid jet head are housed in the kit container 510, but not any ink filling means.

Now, for the present invention, the description has been made of the case where the surface of the discharge openings is in parallel with the object, and the central axis of the first discharge opening and the central axis of the second opening are on one and same plane. However, the present invention is not necessarily limited to this arrangement. For example, the present invention is still applicable to a case where the surface of the discharge openings is not in parallel with the object or where the central axes of the first and second discharge openings are in the positions that may be twisted to each other. In such a case, by use of each of appropriate parameters, the respective conditions can be defined.

Also, as to the structure of the jet head, the description has been made centering on the edge shooter type liquid jet head which is provided with discharge openings in the side position to the bubble generating areas, respectively. However, the present invention is of course applicable to the side shooter type liquid jet head or the like where the discharge openings are positioned to face the bubble generating areas or heat generating units.

Also, in accordance with the above description, the example is illustrated in which one and the same colorant (ink) is dissolved in one and the same solvent, and only two kinds of liquid having different colorant densities are discharged from the first discharge opening 4 and the second discharge opening 5, respectively. Then, these droplets are caused to collide with each other to be mixed before being impacted on a recording medium. The present invention is not necessarily limited to this arrangement. As the combination of the liquids discharged from the first and second discharge openings, various kinds of combination can be used. For example, a combination of two kinds of liquids prepared by dissolving different dyes and pigments by use of one and the same solvent; a combination of two kinds of liquids prepared by dissolving different colorants by use of different solvents; a combination of two kinds of liquids prepared by use of the pigment and bivalent metal or the like which may react upon each other; a combination of two kinds of liquids prepared by dissolving each one kind of two substances that react upon each other, such as anion surfactant or cation surfactant; a combination of the liquid having colorant dissolved in it and the liquid having the stabilizer for such colorant dissolved in it; and a combination of the liquid prepared by dissolving colorant and only solvent, among some others.

Particularly when reactive liquids are combined, the present invention is more effective, because liquid droplets can be combined themselves reliably to react upon each other by setting the discharge speed and discharge timing appropriately (for example, if the reaction period of the liquids is longer, the combination position of the two droplets is made nearer to the head side, while the discharge speed is made slower) so as to satisfy the reaction period within a range of each condition by the application of the liquid discharge method described above.

Also, for the combination to be implemented for a gradation recording, it is possible to allow the droplets from both of the discharge openings to collide with each other reliably before being impacted on an object by the predetermined discharge speeds for the combination of the two discharge openings even if discharge speeds may fluctuate, and also, it is made possible to minimize the deviation of impact position. Therefore, a good gradation image can be output in high quality.

What is claimed is:

1. A liquid discharge method for a liquid jet head provided with first discharge openings, a first liquid flow path conductively connected with each of said first discharge openings, first energy generating devices for generating energy for the discharge of liquid droplets from said first discharge openings, second discharge openings, a second liquid flow path conductively connected with each of said second discharge openings, and second energy generating devices for generating energy for the discharge of liquid droplets from said second discharge openings, the method comprising the steps of:

preceding the discharge of the first liquid droplet from said discharge opening at a first discharge speed $v_1$, discharging the second liquid droplet from said second discharge opening at a second discharge speed $v_2$ smaller than said first discharge speed, and before each of said liquid droplets are impacted on an object, causing said first liquid droplet and said second liquid droplet to collide with each other to be combined, wherein the discharge time differential δT between said first liquid droplet and said second liquid droplet is controlled to satisfy the following condition:

$$\max\left(0, \frac{-L_1(v_1\cos\theta_1 - v_2\cos\theta_2) + (r_1+r_2)\sqrt{v_1^2+v_2^2-2v_1v_2\cos(\theta_1-\theta_2)}}{v_1v_2\sin(\theta_1-\theta_2)}\right) \leq \delta T \leq \frac{-L_1(v_1\cos\theta_1 - v_2\cos\theta_2) - (r_1+r_2)\sqrt{v_1^2+v_2^2-2v_1v_2\cos(\theta_1-\theta_2)}}{v_1v_2\sin(\theta_1-\theta_2)}$$

where the $L_1$ is the distance between a center of the first discharge opening and that of the second discharge opening; the $r_1$ and $r_2$ are the radii of the ink droplets discharged from the first and second discharge openings, respectively; the $\theta_1$ and $\theta_2$ are the angles of ($\theta° \leqq \theta_1 < \theta_2 < 90°$) formed by each of central axes of the first and second discharge openings to the perpendiculars to the discharge opening surface, and max (a, b) is a function for providing a maximum value of a and b.

2. A liquid discharge method according to claim 1, wherein a central axis of said first discharge opening and a central axis of said second discharge opening intersect at one point between said liquid jet head and said object, and at a same time, a discharge timing of said first liquid droplet and second liquid droplet is controlled in accordance with said first discharge speed and second discharge speed so as to enable centers of said first liquid droplet and said second liquid droplet to be in agreement at said intersecting point.

3. A liquid discharge method according to claim 1, wherein an impact position of liquid droplets on said object after being combined is positioned between an individual impact position of the first liquid droplet on said object and an individual impact position of said second liquid droplet on said object.

4. A liquid discharge method according to claim 1, wherein respective differences between two given impact positions among an impact position of the combined liquid droplets on s aid object, an individual impact position of the first liquid droplet on said object, and an individual impact position of the second liquid droplet on said object are within a range of less than dot pitches of pixel density to be output and used for recording images on said object.

5. A liquid discharge method according to claim 4, wherein a difference between said given two impact positions is not more than ½ of the dot pitches of the pixel density of an image to be output.

6. A liquid discharge method according to claim 4, wherein each of differences in said impact positions is within a range of ⅓ of the dot pitches of the pixel density of an image to be output.

7. A liquid discharge method according to claim 1, wherein a mass of said first liquid droplet is larger than a mass of said second liquid droplet.

8. A liquid discharge method according to claim 1, wherein said first discharge speed $v_1$ and said second discharge speed $v_2$ satisfy a condition of $v_1/v_2 > 1.10$.

9. A liquid discharge method according to claim 8, wherein said first discharge speed $v_1$ and said second discharge speed $v_2$ satisfy a condition of 5 m/s$<v_2<v_1<$22 m/s and $v_1/v_2 > 1.56$.

10. A liquid discharge method according to claim 9, wherein said first discharge speed $v_1$ and said second discharge speed $v_2$ satisfy a condition of 5 m/s$<v_2<v_1<$22 m/s and $v_1/v_2 > 1.91$.

11. A liquid discharge method according to claim 8, wherein said first discharge speed $v_1$ and said second discharge speed $v_2$ satisfy a condition of $v_1/v_2 > 1.22$.

12. A liquid discharge method according to claim 1, wherein liquids supplied to said first liquid flow path and said second liquid flow path are a same liquid.

13. A liquid discharge method according to claim 1, wherein a liquid supplied to said first liquid flow path and a liquid supplied to said second liquid flow path are different from each other.

14. A liquid discharge method according to claim 1, wherein a liquid supplied to said first liquid flow path and a liquid supplied to said second liquid flow path are inks that are different from each other in colorant densities thereof.

15. A liquid discharge method according to claim 1, wherein a liquid supplied to said first liquid flow path and a liquid supplied to said second liquid flow path are inks that are different from each other in kinds of colorants.

16. A liquid discharge method according to claim 1, wherein said liquid jet head is provided with a plurality of first discharge openings and a plurality of second discharge opening s corresponding to each of said first discharge openings, respectively.

17. A liquid discharge method according to claim 1, wherein said energy generating devices are bubble generating devices to generate bubbles in liquid and discharge liquid droplets by acting force of said bubbles.

18. A liquid discharge method according to claim 17, wherein said bubble generating devices are heat generating devices to give heat to liquid for creation of bubbles.

19. A liquid discharge method according to claim 18, wherein said heat generating devices are electro-thermal transducing devices.

20. A liquid jet apparatus provided with first discharge openings, a first liquid flow path conductively connected with each of said first discharge openings, first energy generating devices having an arrangement for generating energy for the discharge of liquid droplets from said first discharge openings, second discharge openings, a second liquid flow path conductively connected with each of said second discharge openings, second energy generating devices having an arrangement for generating energy for the discharge of liquid droplets from said second discharge openings, and a driving circuit for driving said first energy generating devices and said second energy generating devices, wherein preceding the discharge of the first liquid droplet from said discharge opening at a first discharge speed $v_1$, the second liquid droplet is discharged from said second discharge opening at a second discharge speed $v_2$, smaller than said first discharge speed, and before each of said liquid droplets is impacted on an object, said first liquid droplet and said second liquid droplet are allowed to collide with each other to be combined, and wherein the discharge time differential δT of said driving circuit between said first liquid droplet and said second liquid droplet is controlled to satisfy the following condition:

$$\max\left(0, \frac{-L_1(v_1\cos\theta_1 - v_2\cos\theta_2) + (r_1+r_2)\sqrt{v_1^2+v_2^2-2v_1v_2\cos(\theta_1-\theta_2)}}{v_1v_2\sin(\theta_1-\theta_2)}\right) \leq$$

-continued $$\delta T \leq \frac{-L_1(v_1\cos\theta_1 - v_2\cos\theta_2) - (r_1 + r_2)\sqrt{v_1^2 + v_2^2 - 2v_1v_2\cos(\theta_1 - \theta_2)}}{v_1v_2\sin(\theta_1 - \theta_2)}$$

where the $L_1$ is the distance between a center of the first discharge opening and that of the second discharge opening; the $r_1$ and $r_2$ are the radii of the ink droplets discharged from the first and second discharge openings, respectively; the $\theta_1$ and $\theta_2$ are the angles of ($0° \leqq \theta_1 < \theta_2 < 90°$) formed by each of central axes of the first and second discharge openings to the perpendiculars to the discharge opening surface, and max (a, b) is a function for providing a maximum value of a and b.

21. A liquid jet apparatus according to claim 20, wherein a locus region of said first liquid droplet and a locus region of said second liquid droplet are provided with an intersection region between said liquid jet apparatus and said object.

22. A liquid jet apparatus according to claim 20, wherein a projection surface on a central axis of said first discharge opening and a projection surface on a central axis of said second discharge opening are provided with an intersection region between said liquid jet apparatus and said object.

23. A liquid jet apparatus according to claim 22, wherein the central axis of said first discharge opening and the central axis of said second discharge opening intersect on one point between said liquid jet apparatus and said object.

24. A liquid jet apparatus according to claim 20, wherein a distance between said liquid jet apparatus and said object is 0.2 mm or more and 3 mm or less.

25. A liquid jet apparatus according to claim 20, wherein the distance between said first discharge opening and said second discharge opening is 3 mm or less.

26. A liquid jet apparatus according to claim 20, wherein an impact position of liquid droplets on said object after being combined is positioned between an individual impact position of the first liquid droplet on said object and an individual impact position of said second liquid droplet on said object.

27. A liquid jet apparatus according to claim 20, wherein respective differences between two given impact positions among an impact position of the combined liquid droplets on said object, an individual impact position of the first liquid droplet on said object, and an individual impact position of the second liquid droplet on said object are less than dot pitches of pixel density to be output and used for recording images on said object.

28. A liquid discharge apparatus according to claim 20, wherein a mass of said first liquid droplet is larger than a mass of said second liquid droplet.

29. A liquid jet apparatus to claim 20, wherein said first discharge speed $v_1$ and said second discharge speed $v_2$ satisfy a condition of $v_1/v_2 > 1.10$.

30. A liquid jet apparatus according to claim 29, wherein said first discharge speed $v_1$ and said second discharge speed $v_2$ satisfy a condition of $v_1/v_2 > 1.22$.

31. A liquid jet apparatus according to claim 20, wherein liquids supplied to said first liquid flow path and said second liquid flow path are a same liquid.

32. A liquid jet apparatus according to claim 20, wherein a liquid supplied to said first liquid flow path and a liquid supplied to said second liquid flow path are different from each other.

33. A liquid jet apparatus according to claim 20, wherein a liquid supplied to said first liquid flow path and a liquid supplied to said second liquid flow path are inks that are different from each other in colorant densities thereof.

34. A liquid jet apparatus according to claim 20, wherein a liquid supplied to said first liquid flow path and a liquid supplied to said second liquid flow path are inks that are different from each other in kinds of colorants.

35. A liquid jet apparatus according to claim 20, wherein said liquid jet apparatus is provided with a plurality of first discharge openings and a plurality of second discharge openings corresponding to each of said first discharge openings, respectively.

36. A liquid jet apparatus according to claim 20, wherein said energy generating devices are bubble generating devices to generate bubbles in liquid and discharge liquid droplets by acting force of said bubbles.

37. A liquid jet apparatus according to claim 36, wherein said bubble generating devices are heat generating devices to give heat to liquid for creation of bubbles.

38. A liquid jet apparatus according to claim 37, wherein said heat generating devices are electrothermal transducing devices.

* * * * *

UNITED STATES PATENT AND TRADEMARK OFFICE

CERTIFICATE OF CORRECTION

PATENT NO. : 6,164,748
DATED : December 26, 2000
INVENTOR(S) : Yoichi Taneya et al.

It is certified that error appears in the above-identified patent and that said Letters Patent is hereby corrected as shown below:

Title page, Item [54] and Column 1, lines 1 and 2,
Title, "LIQUID DISCHARGE METHOD AND LIQUID JET APPARATUS" should read -- LIQUID DISCHARGE METHOD AND LIQUID JET APPARATUS FOR FORMING AN IMAGE USING COMBINED LIQUID DROPLETS HAVING DIFFERENT DISCHARGE VELOCITIES --.

Column 11,
Line 26, "8T" should read -- δT --.

Column 16,
Line 45, "On" should read -- on --.

Column 17,
Line 48, "BA" should read -- 8A --.

Column 20,
Line 52, "drown" should read -- drawn --.

Column 23,
Line 45, "s aid" should read -- said --.

Column 24,
Line 26, "opening s" should read -- openings --.

Signed and Sealed this

Twenty-second Day of July, 2003

JAMES E. ROGAN
*Director of the United States Patent and Trademark Office*